US011878825B2

(12) United States Patent
Engleman et al.

(10) Patent No.: US 11,878,825 B2
(45) Date of Patent: Jan. 23, 2024

(54) PACKAGING MACHINE AND SYSTEMS

(71) Applicant: Packsize LLC, Salt Lake City, UT (US)

(72) Inventors: Clinton Engleman, Layton, UT (US); Raul Zarate, Salt Lake City, UT (US); Alec Wodowski, Salt Lake City, UT (US); Ryan Hermansen, North Salt Lake, UT (US); Javier Jimenez, Salt Lake City, UT (US)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 18/150,050

(22) Filed: Jan. 4, 2023

(65) Prior Publication Data

US 2023/0142034 A1 May 11, 2023

Related U.S. Application Data

(63) Continuation of application No. 17/252,722, filed as application No. PCT/US2019/038142 on Jun. 20, 2019, now Pat. No. 11,634,244.

(Continued)

(51) Int. Cl.
*B65B 35/50* (2006.01)
*B65B 59/00* (2006.01)

(Continued)

(52) U.S. Cl.
CPC ..... *B65B 35/50* (2013.01); *B65B 11/004* (2013.01); *B65B 49/08* (2013.01); *B65B 51/04* (2013.01);

(Continued)

(58) Field of Classification Search
CPC ..... B65B 35/50; B65B 59/001; B65B 11/004; B65B 49/08; B65B 1/04; B65B 51/04; B65B 2210/04

(Continued)

(56) References Cited

U.S. PATENT DOCUMENTS 1,809,853 A 6/1931 Knowlton
2,077,428 A 4/1937 Carl (Continued)

FOREIGN PATENT DOCUMENTS

CN 2164350 Y 5/1994
CN 1191833 A 9/1998

(Continued)

OTHER PUBLICATIONS

Office Action received for U.S. Appl. No. 14/970,224, dated May 30, 2018.

(Continued)

*Primary Examiner* — Chinyere J Rushing-Tucker
(74) *Attorney, Agent, or Firm* — WORKMAN NYDEGGER

(57) ABSTRACT

A system for packaging one or more items includes an order arrangement station where the one or more items can be arranged into a stack with a desired configuration. A dimensioning mechanism determines the outer dimensions of the stack and a converting assembly creates a box template that when erected forms a box that is custom sized to the dimensions of the stack. A crowder assembly holds and maintains the stack in the desired configuration while the box template is at least partially folded around the stack. The box template is secured around the stack in the form of a box.

20 Claims, 27 Drawing Sheets

Related U.S. Application Data

(60) Provisional application No. 62/688,183, filed on Jun. 21, 2018.

(51) Int. Cl.
*B65B 11/00* (2006.01)
*B65B 49/08* (2006.01)
*B65B 51/04* (2006.01)

(52) U.S. Cl.
CPC ..... *B65B 59/001* (2019.05); *B65B 2210/04* (2013.01)

(58) Field of Classification Search
USPC ..... 53/531
See application file for complete search history.

(56) References Cited

U.S. PATENT DOCUMENTS 2,083,351 A 6/1937 Sidebotham
2,181,117 A 11/1939 Brenn
2,256,082 A 9/1941 Feurt
2,353,419 A 7/1944 Smithson
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,853,177 A * 9/1958 Engleson ..... B65B 19/34 198/418.3
2,904,789 A 9/1959 Radin et al.
3,057,267 A 10/1962 Johnson, Jr.
3,096,692 A 7/1963 Crathern et al.
3,105,419 A 10/1963 Leon
3,108,515 A 10/1963 Stohlquist
3,153,991 A 10/1964 Goodrich
3,218,940 A 11/1965 Pearson
3,285,145 A 11/1966 Lieberman
3,303,759 A 2/1967 Burke
3,308,723 A 3/1967 Bergh, Jr.
3,332,207 A 7/1967 Midnight
3,406,611 A 10/1968 Benjamin et al.
3,418,893 A 12/1968 Stohlquist et al.
3,469,508 A 9/1969 Heinz
3,511,496 A 5/1970 Rudolf
3,543,469 A 12/1970 Ullman
3,555,776 A 1/1971 Nigrelli et al.
3,566,755 A 3/1971 Smith et al.
3,611,884 A 10/1971 Hottendorf
3,618,479 A 11/1971 Shields
3,620,114 A 11/1971 Chudyk
3,628,408 A 12/1971 Rod
3,646,418 A 2/1972 Sterns et al.
3,743,154 A 7/1973 Brewitz
3,744,106 A 7/1973 Baum et al.
3,756,586 A 9/1973 Craft
3,763,750 A 10/1973 Reichert
3,776,109 A 12/1973 Clark et al.
3,803,798 A 4/1974 Clancy
3,804,514 A 4/1974 Jasinski
3,807,726 A 4/1974 Hope et al.
3,866,391 A 2/1975 Puskarz et al.
3,882,764 A 5/1975 Johnson
3,886,833 A 6/1975 Gunn et al.
3,891,203 A 6/1975 Schiff
3,912,389 A 10/1975 Miyamoto
3,913,464 A 10/1975 Flaum
3,949,654 A 4/1976 Stehlin
3,986,319 A 10/1976 Puskarz et al.
4,033,217 A 7/1977 Flaum et al.
4,044,658 A 8/1977 Mitchard
4,052,048 A 10/1977 Shirasaka
4,053,152 A 10/1977 Matsumoto
4,056,025 A 11/1977 Rubel
4,094,451 A 6/1978 Wescoat
4,121,506 A 10/1978 Van Grouw
4,123,966 A 11/1978 Buschor
4,162,870 A * 7/1979 Storm ..... B65B 35/50 53/247
4,164,171 A 8/1979 Gorshe et al.
4,173,106 A 11/1979 Leasure et al.
4,184,770 A 1/1980 Pinior
4,191,467 A 3/1980 Schieck
4,221,373 A 9/1980 Mueller Hans
4,222,557 A 9/1980 Wu
4,224,847 A 9/1980 Tokuno
4,252,233 A 2/1981 Joice
4,261,239 A 4/1981 Toboshi et al.
4,264,200 A 4/1981 Tickner et al.
4,295,841 A 10/1981 Ward, Jr.
4,320,960 A 3/1982 Ward et al.
4,342,562 A 8/1982 Froeidh et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,449,349 A 5/1984 Roth
4,480,827 A 11/1984 Shultz et al.
4,487,596 A 12/1984 Livens et al.
4,563,169 A 1/1986 Virta et al.
4,578,054 A 3/1986 Herrin
D286,044 S 10/1986 Kando
4,638,696 A 1/1987 Urwyler
4,674,734 A 6/1987 Yoshiaki
4,684,360 A 8/1987 Tokuno et al.
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
4,994,008 A 2/1991 Haake et al.
5,005,816 A 4/1991 Stemmler et al.
5,024,641 A 6/1991 Boisseau
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,106,359 A 4/1992 Lott
5,111,252 A 5/1992 Hamada et al.
5,116,034 A 5/1992 Trask et al.
5,118,093 A 6/1992 Makiura et al.
5,120,279 A 6/1992 Rabe
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell
5,148,654 A 9/1992 Kisters
5,154,041 A 10/1992 Schneider
5,157,903 A 10/1992 Nakashima et al.
5,197,366 A 3/1993 Paulson et al.
5,240,243 A 8/1993 Gompertz et al.
5,241,353 A 8/1993 Maeshima et al.
5,259,255 A 11/1993 Urban et al.
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.

(56) References Cited

U.S. PATENT DOCUMENTS 5,358,345 A 10/1994 Damitio
5,369,939 A 12/1994 Moen et al.
5,375,390 A 12/1994 Frigo et al.
5,397,423 A 3/1995 Bantz et al.
5,411,252 A 5/1995 Lowell
5,531,661 A 7/1996 Moncrief
5,584,633 A 12/1996 Scharer
5,586,758 A 12/1996 Kimura et al.
5,624,369 A 4/1997 Bidlack et al.
5,667,468 A 9/1997 Bandura
5,671,593 A 9/1997 Ginestra et al.
5,716,313 A 2/1998 Sigrist et al.
5,727,725 A 3/1998 Paskvich
5,767,975 A 6/1998 Hans
5,836,498 A 11/1998 Turek
5,865,918 A 2/1999 Franklin et al.
5,887,867 A 3/1999 Takahashi et al.
5,902,223 A 5/1999 Simmons
5,927,702 A 7/1999 Ishii et al.
5,941,451 A 8/1999 Dexter
5,964,686 A 10/1999 Bidlack et al.
6,000,525 A 12/1999 Frulio
6,071,223 A 6/2000 Reider et al.
6,076,764 A 6/2000 Robinson
6,107,579 A 8/2000 Kinnemann
6,113,525 A 9/2000 Waechter
6,135,438 A 10/2000 Newman et al.
6,164,045 A 12/2000 Focke et al.
6,179,765 B1 1/2001 Toth
6,189,933 B1 2/2001 Felderman
6,244,436 B1 6/2001 Boriani et al.
6,245,004 B1 6/2001 Waters
6,321,650 B1 11/2001 Ogawa et al.
6,397,557 B1 6/2002 Bassissi et al.
6,428,000 B1 8/2002 Hara et al.
6,471,154 B2 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,709,177 B1 3/2004 Sugimura
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,968,859 B1 11/2005 Nagano et al.
7,060,016 B2 6/2006 Cipolli
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,735,299 B2 6/2010 Cash, III
7,739,856 B2 6/2010 Cash, III
7,997,578 B2 8/2011 Saito et al.
8,052,138 B2 11/2011 Wang
8,141,868 B1 3/2012 Wang et al.
8,646,248 B2 * 2/2014 Iwasa ..... B65B 5/06 53/244
D703,246 S 4/2014 Pettersson et al.
8,999,108 B2 4/2015 Nagao et al.
9,027,315 B2 5/2015 Tsutsumi et al.
9,069,151 B2 6/2015 Conner
9,120,284 B2 9/2015 Capoia
9,199,794 B2 12/2015 Nadachi et al.
9,216,867 B2 12/2015 Aoyama
9,329,565 B2 5/2016 Osaki
9,352,526 B2 5/2016 Pettersson
9,434,496 B2 9/2016 Sytema
9,771,231 B2 9/2017 Pettersson
9,924,502 B2 3/2018 Choi
9,969,142 B2 5/2018 Pettersson et al.
10,093,438 B2 10/2018 Pettersson
10,155,352 B2 12/2018 Sytema et al.
10,286,621 B2 5/2019 Toro
10,583,943 B2 3/2020 Feijen et al.
10,836,516 B2 11/2020 Pettersson
10,836,517 B2 11/2020 Ponti
2002/0017754 A1 2/2002 Kang
2002/0066683 A1 6/2002 Sanders
2002/0091050 A1 7/2002 Bacciottini et al.
2002/0108476 A1 8/2002 Guidetti
2002/0115548 A1 8/2002 Lin et al.
2002/0125712 A1 9/2002 Felderman
2002/0139890 A1 10/2002 Toth
2003/0102244 A1 6/2003 Sanders
2003/0104911 A1 6/2003 Toth et al.
2003/0217628 A1 11/2003 Michalski
2004/0060264 A1 4/2004 Miller
2004/0082453 A1 4/2004 Pettersson
2004/0092374 A1 5/2004 Cheng
2004/0144555 A1 7/2004 Buekers et al.
2004/0173068 A1 9/2004 Adachi
2004/0198577 A1 10/2004 Blumle
2004/0214703 A1 10/2004 Berens et al.
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0082044 A1 4/2006 Aida
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0227927 A1 10/2007 Andrea
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0011924 A1 1/2010 Bernreuter
2010/0012628 A1 1/2010 Koshy et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2011/0026999 A1 2/2011 Kohira
2011/0053746 A1 3/2011 Desertot et al.
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0240707 A1 10/2011 Beguin et al.
2011/0269995 A1 11/2011 Olbert et al.
2011/0283855 A1 11/2011 Kwarta et al.
2011/0319242 A1 12/2011 Pettersson
2012/0021884 A1 1/2012 Musha
2012/0037680 A1 2/2012 Shun
2012/0106963 A1 5/2012 Huang et al.
2012/0122640 A1 5/2012 Pazdernik et al.
2012/0129670 A1 5/2012 Pettersson et al.
2012/0139670 A1 6/2012 Yamagata et al.
2012/0142512 A1 6/2012 Keller
2012/0242512 A1 9/2012 Horstemeyer
2012/0275838 A1 11/2012 Imazu et al.
2012/0319920 A1 12/2012 Athley et al.

(56) References Cited

U.S. PATENT DOCUMENTS

| | | | |
|---|---|---|---|
| 2012/0328253 | A1 | 12/2012 | Hurley et al. |
| 2013/0000252 | A1* | 1/2013 | Pettersson ..... B65B 5/024 348/46 |
| 2013/0045847 | A1 | 2/2013 | Capoia |
| 2013/0104718 | A1 | 5/2013 | Tai |
| 2013/0108227 | A1 | 5/2013 | Conner |
| 2013/0108408 | A1 | 5/2013 | Saison et al. |
| 2013/0130877 | A1 | 5/2013 | Su |
| 2013/0146355 | A1 | 6/2013 | Strasser et al. |
| 2013/0210597 | A1 | 8/2013 | Pettersson |
| 2013/0294735 | A1 | 11/2013 | Burris et al. |
| 2013/0333538 | A1 | 12/2013 | Long et al. |
| 2014/0078635 | A1 | 3/2014 | Conner et al. |
| 2014/0091511 | A1 | 4/2014 | Martin |
| 2014/0100100 | A1 | 4/2014 | Izumichi |
| 2014/0101929 | A1 | 4/2014 | Kim et al. |
| 2014/0121093 | A1 | 5/2014 | Braschoss et al. |
| 2014/0140671 | A1 | 5/2014 | Islam |
| 2014/0141956 | A1 | 5/2014 | Suzuki et al. |
| 2014/0171283 | A1 | 6/2014 | Furuhashi et al. |
| 2014/0179504 | A1 | 6/2014 | Nakada et al. |
| 2014/0206518 | A1 | 7/2014 | Hidaka et al. |
| 2014/0315701 | A1 | 10/2014 | Pettersson |
| 2014/0316336 | A1 | 10/2014 | Hawasheen |
| 2014/0318336 | A1 | 10/2014 | De Marco et al. |
| 2014/0336026 | A1 | 11/2014 | Pettersson |
| 2014/0357463 | A1 | 12/2014 | Kojima |
| 2015/0018189 | A1 | 1/2015 | Pettersson et al. |
| 2015/0019387 | A1 | 1/2015 | Pettersson et al. |
| 2015/0045197 | A1 | 2/2015 | Sugiyama et al. |
| 2015/0053349 | A1 | 2/2015 | Mori et al. |
| 2015/0055926 | A1 | 2/2015 | Strasser et al. |
| 2015/0103923 | A1 | 4/2015 | Ramasubramonian et al. |
| 2015/0148210 | A1 | 5/2015 | Sibthorpe |
| 2015/0155697 | A1 | 6/2015 | Loveless et al. |
| 2015/0224731 | A1 | 8/2015 | Ponti |
| 2015/0273897 | A1 | 10/2015 | Kato et al. |
| 2015/0355429 | A1 | 12/2015 | Villegas et al. |
| 2015/0360433 | A1 | 12/2015 | Feijen et al. |
| 2015/0360801 | A1* | 12/2015 | Sytema ..... B65B 49/16 53/74 |
| 2016/0001441 | A1 | 1/2016 | Osterhout et al. |
| 2016/0049782 | A1 | 2/2016 | Strasser et al. |
| 2016/0122044 | A1 | 5/2016 | Evers et al. |
| 2016/0184142 | A1 | 6/2016 | Vanvalkenburgh et al. |
| 2016/0185065 | A1 | 6/2016 | Sytema et al. |
| 2016/0185475 | A1 | 6/2016 | Pettersson |
| 2016/0229145 | A1 | 8/2016 | Pettersson et al. |
| 2016/0241468 | A1 | 8/2016 | Sabella et al. |
| 2016/0340067 | A1 | 11/2016 | Winkler et al. |
| 2017/0057190 | A1 | 3/2017 | Toro |
| 2017/0190134 | A1 | 7/2017 | Van et al. |
| 2017/0355166 | A1 | 12/2017 | Jonker |
| 2017/0361560 | A1 | 12/2017 | Osterhout |
| 2018/0050833 | A1* | 2/2018 | Sytema ..... B65B 5/028 |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson |
| 2019/0389611 | A1 | 12/2019 | Pettersson |
| 2020/0031506 | A1 | 1/2020 | Ponti |
| 2020/0101686 | A1 | 4/2020 | Fredander et al. |
| 2020/0407087 | A1 | 12/2020 | Pettersson |
| 2021/0001583 | A1 | 1/2021 | Osterhout |
| 2021/0039347 | A1 | 2/2021 | Pettersson et al. |
| 2021/0261281 | A1 | 8/2021 | Engleman et al. |
| 2021/0370633 | A1 | 12/2021 | Provoost et al. |
| 2021/0371229 | A1 | 12/2021 | Osterhout |
| 2022/0153462 | A1 | 5/2022 | Provoost et al. |

FOREIGN PATENT DOCUMENTS

| | | | |
|---|---|---|---|
| CN | 1275515 | A | 12/2000 |
| CN | 1366487 | A | 8/2002 |
| CN | 1449966 | A | 10/2003 |
| CN | 1494502 | A | 5/2004 |
| CN | 1876361 | A | 12/2006 |
| CN | 2925862 | Y | 7/2007 |
| CN | 201941185 | U | 8/2011 |
| CN | 201990294 | U | 9/2011 |
| CN | 102264532 | A | 11/2011 |
| CN | 102371705 | A | 3/2012 |
| CN | 102574654 | A | 7/2012 |
| CN | 202412794 | U | 9/2012 |
| CN | 102753442 | A | 10/2012 |
| CN | 102756943 | A | 10/2012 |
| CN | 102791581 | A | 11/2012 |
| CN | 103534069 | A | 1/2014 |
| CN | 104044166 | A | 9/2014 |
| CN | 104169073 | A | 11/2014 |
| CN | 104185538 | A | 12/2014 |
| CN | 102941592 | | 4/2015 |
| CN | 104812560 | A | 7/2015 |
| CN | 104890208 | A | 9/2015 |
| CN | 104985868 | A | 10/2015 |
| CN | 204773785 | U | 11/2015 |
| CN | 106079570 | A | 11/2016 |
| CN | 107206216 | A | 9/2017 |
| CN | 107614253 | A | 1/2018 |
| DE | 1082227 | | 5/1960 |
| DE | 1212854 | B | 3/1966 |
| DE | 2700004 | A1 | 7/1978 |
| DE | 2819000 | A1 | 11/1978 |
| DE | 3343523 | A1 | 6/1985 |
| DE | 3825506 | A1 | 2/1990 |
| DE | 19541061 | C1 | 11/1996 |
| DE | 10355544 | A1 | 6/2005 |
| DE | 102005063193 | A1 | 7/2007 |
| DE | 102008035278 | A1 | 2/2010 |
| EP | 0030366 | A1 | 6/1981 |
| EP | 0234228 | A2 | 9/1987 |
| EP | 0359005 | A1 | 3/1990 |
| EP | 0650827 | A2 | 5/1995 |
| EP | 0889779 | A2 | 1/1999 |
| EP | 0903219 | A2 | 3/1999 |
| EP | 1065162 | A2 | 1/2001 |
| EP | 1223107 | A1 | 7/2002 |
| EP | 1373112 | A1 | 1/2004 |
| EP | 1428759 | A2 | 6/2004 |
| EP | 1997736 | A2 | 12/2008 |
| EP | 1497049 | B1 | 3/2010 |
| EP | 2228206 | A1 | 9/2010 |
| EP | 2377764 | A1 | 10/2011 |
| EP | 3231594 | A1 | 10/2017 |
| FR | 0428967 | A | 9/1911 |
| FR | 1020458 | A | 2/1953 |
| FR | 1592372 | A | 5/1970 |
| FR | 2280484 | A1 | 2/1976 |
| FR | 2411700 | A1 | 7/1979 |
| FR | 2626642 | A1 | 8/1989 |
| FR | 2721301 | A1 | 12/1995 |
| FR | 2770445 | A1 | 5/1999 |
| FR | 2808722 | A1 | 11/2001 |
| FR | 2814393 | A1 | 3/2002 |
| FR | 2976561 | A1 | 12/2012 |
| GB | 0166622 | | 7/1921 |
| GB | 0983946 | A | 2/1965 |
| GB | 1362060 | A | 7/1974 |
| GB | 1546789 | A | 5/1979 |
| JP | 49-099239 | A | 9/1974 |
| JP | 50-078616 | A | 6/1975 |
| JP | 51-006358 | Y1 | 2/1976 |
| JP | 51-027619 | A | 3/1976 |
| JP | 51-098591 | A | 8/1976 |
| JP | 55-057984 | A | 4/1980 |
| JP | 56-089937 | A | 7/1981 |
| JP | 59-176836 | A | 10/1984 |
| JP | 59-198243 | A | 11/1984 |
| JP | 61-118720 | A | 6/1986 |

(56) References Cited

FOREIGN PATENT DOCUMENTS

| | | | |
|---|---|---|---|
| JP | 62-172032 | | 10/1987 |
| JP | 01-133164 | A | 5/1989 |
| JP | 03-070927 | A | 3/1991 |
| JP | 3089399 | | 9/1991 |
| JP | 06-123606 | A | 5/1994 |
| JP | 06-142585 | A | 5/1994 |
| JP | 07-156305 | A | 6/1995 |
| JP | 08-132388 | A | 5/1996 |
| JP | 08-238690 | A | 9/1996 |
| JP | 08-333036 | A | 12/1996 |
| JP | 09-506847 | A | 7/1997 |
| JP | 09-510548 | A | 10/1997 |
| JP | 11-320492 | A | 11/1999 |
| JP | 2000-323324 | A | 11/2000 |
| JP | 2003-079446 | A | 3/2003 |
| JP | 2003-112849 | A | 4/2003 |
| JP | 2003-165167 | A | 6/2003 |
| JP | 2003-194516 | A | 7/2003 |
| JP | 2004-330351 | A | 11/2004 |
| JP | 2005-067019 | A | 3/2005 |
| JP | 2005-219798 | A | 8/2005 |
| JP | 2006-289914 | A | 10/2006 |
| JP | 2007-331810 | A | 12/2007 |
| JP | 2008-254789 | A | 10/2008 |
| JP | 2009-023074 | | 2/2009 |
| JP | 2009-132049 | A | 6/2009 |
| JP | 2010-012628 | A | 1/2010 |
| JP | 2011-053284 | A | 3/2011 |
| JP | 2011-520674 | A | 7/2011 |
| JP | 2011-230385 | A | 11/2011 |
| JP | 2015-502273 | A | 1/2015 |
| JP | 2016-074133 | A | 5/2016 |
| JP | 2020-504038 | A | 2/2020 |
| JP | 2021-521067 | A | 8/2021 |
| JP | 2022-017471 | A | 1/2022 |
| RU | 2015030 | C1 | 6/1994 |
| RU | 2004136918 | A | 5/2006 |
| RU | 2334668 | C2 | 9/2008 |
| RU | 2345893 | C2 | 2/2009 |
| RU | 2398674 | C1 | 9/2010 |
| RU | 2014123534 | A | 12/2015 |
| RU | 2014123562 | A | 12/2015 |
| SE | 0450829 | B | 8/1987 |
| SE | 450829 | B | 8/1987 |
| SE | 515630 | C2 | 9/2001 |
| SU | 40025 | A1 | 12/1934 |
| SU | 213570 | A1 | 3/1968 |
| SU | 992220 | A1 | 1/1983 |
| SU | 1054863 | A1 | 11/1983 |
| SU | 1121156 | A1 | 10/1984 |
| SU | 1676825 | A1 | 9/1991 |
| SU | 1718783 | A1 | 3/1992 |
| SU | 1756211 | A1 | 8/1992 |
| TW | 394741 | B | 6/2000 |
| WO | 95/24298 | A1 | 9/1995 |
| WO | 96/10518 | A1 | 4/1996 |
| WO | 96/14773 | A1 | 5/1996 |
| WO | 97/31773 | A2 | 9/1997 |
| WO | 99/17923 | A1 | 4/1999 |
| WO | 00/21713 | A1 | 4/2000 |
| WO | 01/04017 | A1 | 1/2001 |
| WO | 01/85408 | A2 | 11/2001 |
| WO | 02/79062 | A1 | 10/2002 |
| WO | 03/89163 | A2 | 10/2003 |
| WO | 03/97340 | | 11/2003 |
| WO | 2009/093936 | A1 | 7/2009 |
| WO | 2010/091043 | A1 | 8/2010 |
| WO | 2011/007237 | A1 | 1/2011 |
| WO | 2011/100078 | A2 | 8/2011 |
| WO | 2011/135433 | A1 | 11/2011 |
| WO | 2012/003167 | A1 | 1/2012 |
| WO | 2013/071073 | A1 | 5/2013 |
| WO | 2013/071080 | A1 | 5/2013 |
| WO | 2013/106180 | A1 | 7/2013 |
| WO | 2013/114057 | A2 | 8/2013 |
| WO | 2014/048934 | A1 | 4/2014 |
| WO | 2014/117816 | | 8/2014 |
| WO | 2014/117817 | A1 | 8/2014 |
| WO | 2014/188010 | A2 | 11/2014 |
| WO | 2015/173745 | A1 | 11/2015 |
| WO | 2016/176271 | A1 | 11/2016 |
| WO | 2017/203399 | A1 | 11/2017 |
| WO | 2017/203401 | A1 | 11/2017 |
| WO | 2017/218296 | A1 | 12/2017 |
| WO | 2017/218297 | A1 | 12/2017 |
| WO | 2019/246344 | A1 | 12/2019 |

OTHER PUBLICATIONS

Office Action received for U.S. Appl. No. 15/616,688, dated Mar. 19, 2020.

Office Action received for U.S. Appl. No. 15/872,770, dated Mar. 27, 2020.

Office Action received for U.S. Appl. No. 15/901,089, dated Apr. 13, 2020.

Office Action received for U.S. Appl. No. 16/109,261, dated Apr. 28, 2020.

Office Action received for U.S. Appl. No. 29/419,922, dated Aug. 6, 2013.

Definition of Against, per Merriam-Webster, retrieved on Oct. 4, 2022 from URL: https://www.merriam-webster.com/dictionary/against (Year: 2022).

Definition of Cam, per "Oxford Languages", retreived on Sep. 29, 2022 from (abridged) URL: https://tinyurl.com/17082294URL1 (Year: 2022).

Final Office Action received for U.S. Appl. No. 13/147,787, dated Apr. 17, 2015.

Final Office Action received for U.S. Appl. No. 13/147,787, dated Feb. 16, 2016.

Final Office Action received for U.S. Appl. No. 13/147,787, dated Mar. 7, 2017.

Final Office Action received for U.S. Appl. No. 14/357,183, dated Nov. 12, 2015.

Final Office Action received for U.S. Appl. No. 14/357,190, dated Aug. 1, 2017.

Final Office Action received for U.S. Appl. No. 14/370,729, dated Jul. 12, 2017.

Final Office Action received for U.S. Appl. No. 15/872,770, dated Sep. 16, 2020, 17 pages.

Final Office Action received for U.S. Appl. No. 16/619,818, dated Feb. 3, 2022, 10 pages.

Final Office Action received for U.S. Appl. No. 17/023,088, dated Nov. 8, 2022, 20 pages.

Final Office Action received for U.S. Appl. No. 17/082,294, dated Jan. 20, 2023, 13 pages.

International Search Report and Written Opinion for application No. PCT/US2012/070719 dated Feb. 25, 2013.

International Search Report and Written Opinion for application No. PCT/US2017/036603 dated Oct. 18, 2017.

International Search Report and Written Opinion for application No. PCT/US2017/036606 dated Oct. 24, 2017.

International Search Report and Written Opinion for corresponding PCT Application No. PCT/IB2015/054179, dated Aug. 28, 2015, 13 pages.

International Search Report and Written Opinion for PCT/US18/14275 dated Apr. 4, 2018.

International Search Report and Written Opinion for PCT/US19/62696 dated Feb. 4, 2020.

International Search Report and Written Opinion for PCT/US2012/064414 dated Jan. 25, 2013.

International Search Report and Written Opinion for PCT/US2015/67375 dated Mar. 11, 2016.

International Search Report and Written Opinion for PCT/US2019/049102 dated Dec. 2, 2019.

International Search Report and Written Opinion from International Application No. PCT/US2010/022983 dated Apr. 13, 2010.

International Search Report and Written Opinion issued in PCT/US2018/032311 dated Sep. 20, 2018.

(56) References Cited

OTHER PUBLICATIONS

International Search Report and Written Opinion issued in PCT/US2019/038142 dated Aug. 19, 2019.
International Search Report and Written Opinion PCT/IB2019/052793 dated Nov. 11, 2019.
International Search Report and Written Opinion PCT/IB2019/052794 dated Jun. 19, 2019.
International Search Report and Written Opinion received for PCT Patent Application No. PCT/US2018/020928, dated Jun. 7, 2018, 9 pages.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 19 pages.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
International Search Report for PCT/US2011/042096 dated Oct. 28, 2011.
Non-Final Office Action received for U.S. Appl. No. 15/872,770, dated Nov. 10, 2020, 24 pages.
Non-Final Office Action received for U.S. Appl. No. 16/310,406, dated Aug. 19, 2020, 22 pages.
Non-Final Office Action received for U.S. Appl. No. 16/375,579, dated Feb. 18, 2021, 12 pages.
Non-Final Office Action received for U.S. Appl. No. 16/375,588, dated Jul. 2, 2021, 15 pages.
Non-Final Office Action received for U.S. Appl. No. 16/619,818, dated Aug. 31, 2021, 13 pages.
Non-Final Office Action received for U.S. Appl. No. 17/023,088, dated May 10, 2022, 11 pages.
Non-Final Office Action received for U.S. Appl. No. 17/082,294, dated Oct. 12, 2022, 12 pages.
Non-Final Office Action received for U.S. Appl. No. 17/252,722, dated Sep. 9, 2022, 13 pages.
Non-Final Office Action received for U.S. Appl. No. 17/587,836, dated Mar. 1, 2023, 14 pages.
Notice of Allowance received for U.S. Appl. No. 15/901,089, dated Jan. 31, 2022, 9 pages.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/147,787, dated Sep. 30, 2015.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Office Action received for U.S. Appl. No. 14/370,729, dated Jan. 26, 2017.

* cited by examiner

PACKAGING MACHINE AND SYSTEMS

CROSS-REFERENCE TO RELATED APPLICATIONS

This application is a continuation of U.S. application Ser. No. 17/252,722, filed Dec. 15, 2020, entitled "PACKAGING MACHINE AND SYSTEMS", which claims priority to PCT Application No. PCT/US2019/038142, filed Jun. 20, 2019, entitled "PACKAGING MACHINE AND SYSTEMS", which claims priority to and the benefit of U.S. Provisional Patent Application Ser. No. 62/688,183, filed Jun. 21, 2018, and entitled "PACKAGING MACHINE AND SYSTEMS". Each of the aforementioned applications are incorporated by reference herein in their entirety.

BACKGROUND

1. The Field of the Invention

Exemplary embodiments of the disclosure relate to systems, methods, and devices for packaging items into boxes. More specifically, exemplary embodiments relate to packaging machines that maintain an arrangement of one or more items and fold and secure a custom box template around the item(s) to package the item(s) in a custom box.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks.

For instance, previous systems have focused primarily on the creation of boxes and sealing the boxes once they are filled. Such systems have required the use of multiple separate machines and significant manual labor. By way of example, a typical box forming system includes a converting machine that cuts, scores, and/or creases sheet material to form a box template. Once the template is formed, an operator removes the template from the converting machine and a manufacturer's joint is created in the template. A manufacturer's joint is where two opposing ends of the template are attached to one another. This can be accomplished manually and/or with additional machinery. For instance, an operator can apply glue (e.g., with a glue gun) to one end of the template and can fold the template to join the opposing ends together with the glue therebetween. Alternatively, the operator can at least partially fold the template and insert the template into a gluing machine that applies glue to one end of the template and joins the two opposing ends together. In either case, significant operator involvement is required. Additionally, using a separate gluing machine complicates the system and can significantly increase the size of the overall system.

Once the manufacturer's joint is created, the template can be partially erected and bottom flaps of the template can be folded and secured to form a bottom surface of a box. Again, an operator typically has to erect the box. The bottom flaps can be folded and secured manually by the operator or with the assistance of yet additional machines. Thereafter, an operator transfers the to-be-packaged item(s) into the box and the top flaps are folded and secured.

Accordingly, it would be advantageous to have a packaging machine that can form box templates and fold and secure the templates around the to-be-packaged item(s) without significant manual labor.

BRIEF SUMMARY

Exemplary embodiments of the disclosure relate to systems, methods, and devices for packaging item(s) into boxes. More specifically, exemplary embodiments relate to packaging machines that maintain an arrangement of one or more items and fold and secure a custom box template around the item(s) to package the item(s) in a custom box.

For instance, one embodiment of a packaging machine includes a frame structure and a crowder assembly movably mounted on the frame structure. The crowder assembly can be configured to receive and maintain an arrangement of a stack of one or more items during a packaging process. The crowder assembly can include a first half comprising a sidewall and a second half comprising a sidewall. At least one of the first half and the second half also includes a back wall. Likewise, at least one of the first half and the second half also includes a floor. The sidewall of the second half can be positioned opposite the sidewall of the first half and can be selectively movable towards and away from the sidewall of the first half. The crowder assembly can also include a front wall assembly that has a variable width to enable the front wall to be positioned between the sidewalls of the first and second halves. The front wall assembly can be selectively movable towards the back wall.

According to another embodiment, a system for packaging one or more items includes an order arrangement station where the one or more items can be arranged into a stack and a dimensioning mechanism configured to determine outer dimensions of the stack. The system can also include a converting assembly configured to create a box template that when erected forms a box that is custom sized to the dimensions of the stack. A crowder assembly can be included that is configured to hold and maintain the stack in a desired configuration while the box template is at least partially folded around the stack. Folding mechanism(s) can fold the box template around the stack and a fastening apparatus can apply one or more fasteners to the box template to secure the box template around the stack in the form of a box.

According to another embodiment, a method for packaging one or more items includes arranging the one or more items into a stack with a desired configuration and determining the outer dimensions of the stack. The method also includes creating a box template that when erected forms a box that is custom sized to the dimensions of the stack and depositing the stack in a crowder assembly configured to hold and maintain the stack in the desired configuration while the box template is at least partially folded around the stack. The method further includes folding the box template around the stack and securing the box template around the stack in the form of a box.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The embodiments described herein generally relate to systems, methods, and devices for packaging item(s) into boxes. More specifically, the described embodiments relate to machines that maintain an arrangement of one or more items and fold and secure a custom box template around the item(s) to package the item(s) in a custom box.

While the present disclosure will be described in detail with reference to specific configurations, the descriptions are illustrative and are not to be construed as limiting the scope of the present disclosure. Various modifications can be made to the illustrated configurations without departing from the spirit and scope of the invention as defined by the claims. For better understanding, like components have been designated by like reference numbers throughout the various accompanying figures.

As used herein, the term "box template" shall refer to a substantially flat stock of material that can be folded into a box-like shape. A box template may have notches, cutouts, divides, and/or creases that allow the box template to be bent and/or folded into a box. Additionally, a box template may be made of any suitable material, generally known to those skilled in the art. For example, cardboard or corrugated paperboard may be used as the box template material. A suitable material also may have any thickness and weight that would permit it to be bent and/or folded into a box-like shape.

Figure 1:
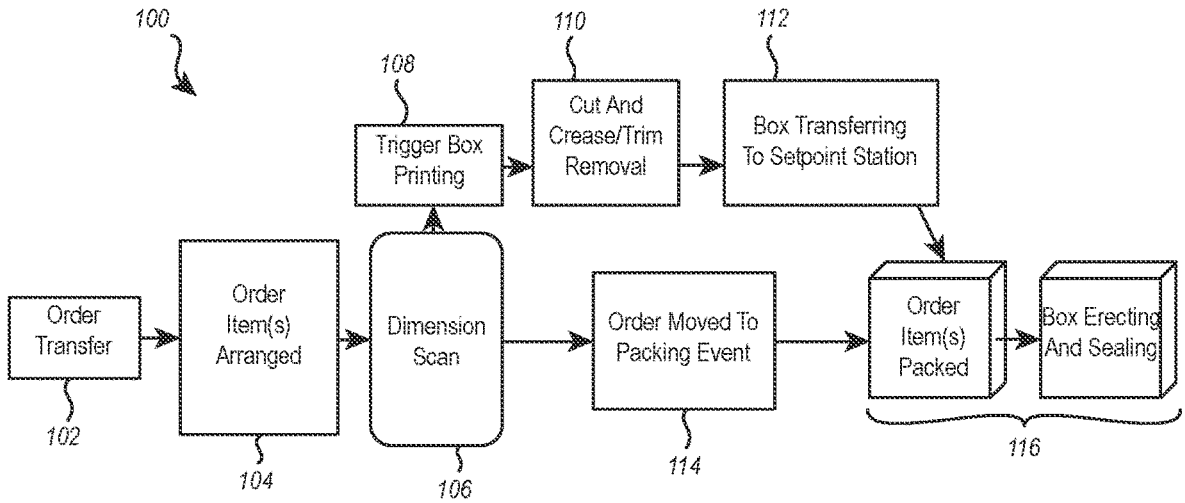
FIG. 1 illustrates a flowchart of example process steps for packaging item(s).

FIG. 1 illustrates an example method or set of process steps 100 for packaging one or more items in a box. The process 100 may be used to package items in a box for shipping or other purposes and may reduce the amount of work or other involvement required of individuals to package the items.

The method 100 begins with an order transfer 102. The order transfer 102 may comprise a variety of steps including receiving an order from a customer, collecting the ordered item(s), and/or transferring or otherwise delivering the ordered item(s) to a packaging station for measurement and/or packaging.

After the order transfer 102, the ordered item(s) may be arranged (step 104). For instance, if the order includes a single item, that item maybe positioned in a desired orientation for packaging. On the other hand, if the order includes multiple items, the items may be arranged in a desired configuration for packaging (referred to hereinafter as a "stack"). For instance, the items may be arranged into a stack that takes up a minimum volume, that positions smaller items on top of larger items, etc. In some embodiments, arranging the item(s) may be done by an operator or by one or more mechanical devices.

Once the item(s) are arranged into a stack, a dimensional scam may be taken of the stack (step 106). For instance, one or more dimensioning mechanisms may be used to determine the outer dimensions of the stack. Example dimensioning mechanisms may include three dimensional cameras or scanners, light curtains, measuring tapes, or the like.

Obtaining the dimensions of the stack can trigger the printing of box template (step 108). For example, the dimensions of the stack may be transferred (automatically or manually) to a machine that creates custom sized box templates. The box template forming machine may then form cuts and/or creases in a stock material (e.g., cardboard or corrugated paperboard) to form a box template custom sized for the stack of items (step 110). The box template can then be transferred to a packaging station (step 112).

While a box template is being formed, the stack of items may be moved to the packaging station (step 114). At the packaging station, the stack of items can be packed, which can include erecting the box template around the stack of items and sealing the box (step 116). In some embodiments, step 116 also includes labeling the box (e.g., applying or printing a shipping label on the box).

Figure 2:
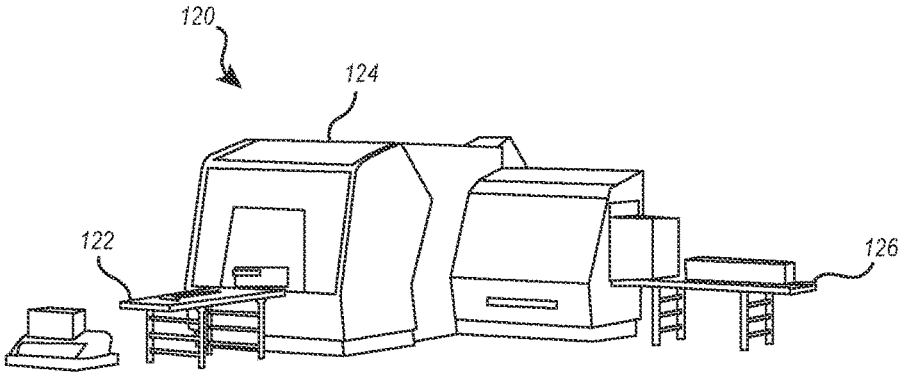
FIG. 2 illustrates an example system for packaging item(s).

FIG. 2 illustrates an example system 120 used in performing process 100. In the illustrated embodiment, items for packaging are delivered to the system 120. The items may be positioned and arranged into a stack on the conveyor 122. The dimensions of the stack may be obtained while the stack is positioned on the conveyor 122, either before the stack enters the packaging machine 124 or once the stack is moved inside of the packaging machine 124. That is, the dimensioning mechanisms used to obtain the dimensions of stack may be positioned outside or inside the packaging machine 124.

In any event, the stack of items is advanced into the packaging machine 124 on conveyor 122. The packaging machine 124 creates a box template custom sized for the stack of items and folds and secures the box template around the stack of items. The packaged stack is then advanced out of the packaging machine 124 on another conveyor 126.

FIGS. 3-25 illustrate exemplary embodiments of internal components of packaging machine 124 that are used to package stacks of items in custom sized boxes. Although specific embodiments of internal components of packaging machine 124 are shown and described, it will be appreciated that the specific implementations are merely exemplary. Variations to the shown and described components may be made without departing from the scope of the present disclosure. Rather, the present disclosure is intended to encompass components that perform the basic functions described herein.

Figure 3:
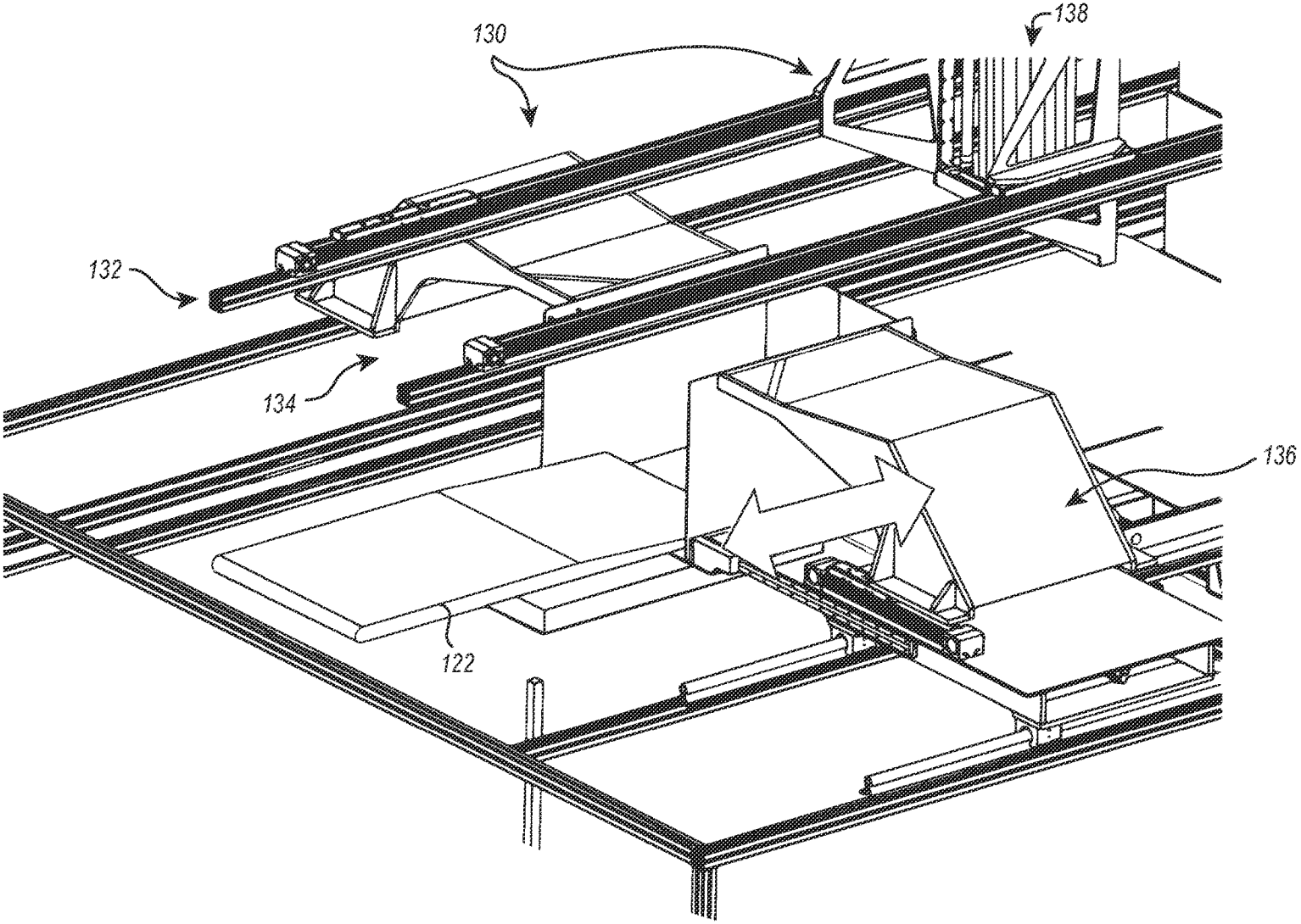
FIG. 3 illustrates a conveyor and a crowder assembly of the system of FIG. 2.

FIG. 3 illustrates conveyor 122 upon which a stack of items is conveyed into the packaging machine 124. The conveyor 122 delivers the stack of items to a crowder assembly 130. As will be described below, the crowder assembly 130 is configured to maintain the stack of items in the configuration created during step 104 described above while a box template is folded and secured around the stack of items.

As can be seen in FIG. 3, the crowder assembly 130 is movably mounted on a frame structure 132 such that the crowder assembly can move (in the direction indicated by the double headed arrow) towards and away from conveyor 122. In the illustrated embodiment, the crowder assembly 130 includes a first half 134, a second half 136, and a front wall assembly 138.

Attention is now directed to FIGS. 4-7 which illustrate the crowder assembly 130 separate from the rest of packaging machine 124. In the illustrated embodiment, the first half 134 and the second half 136 are substantially mirror images of one another. For instance, the first and second halves 134, 136 each include a back wall 140, a floor 142, and a sidewall 144. In some embodiments, the back wall 140 and the floor 142 of the first half 134 are connected together and the back wall 140 and the floor 142 of the second half 136 are connected together.

Figure 4:
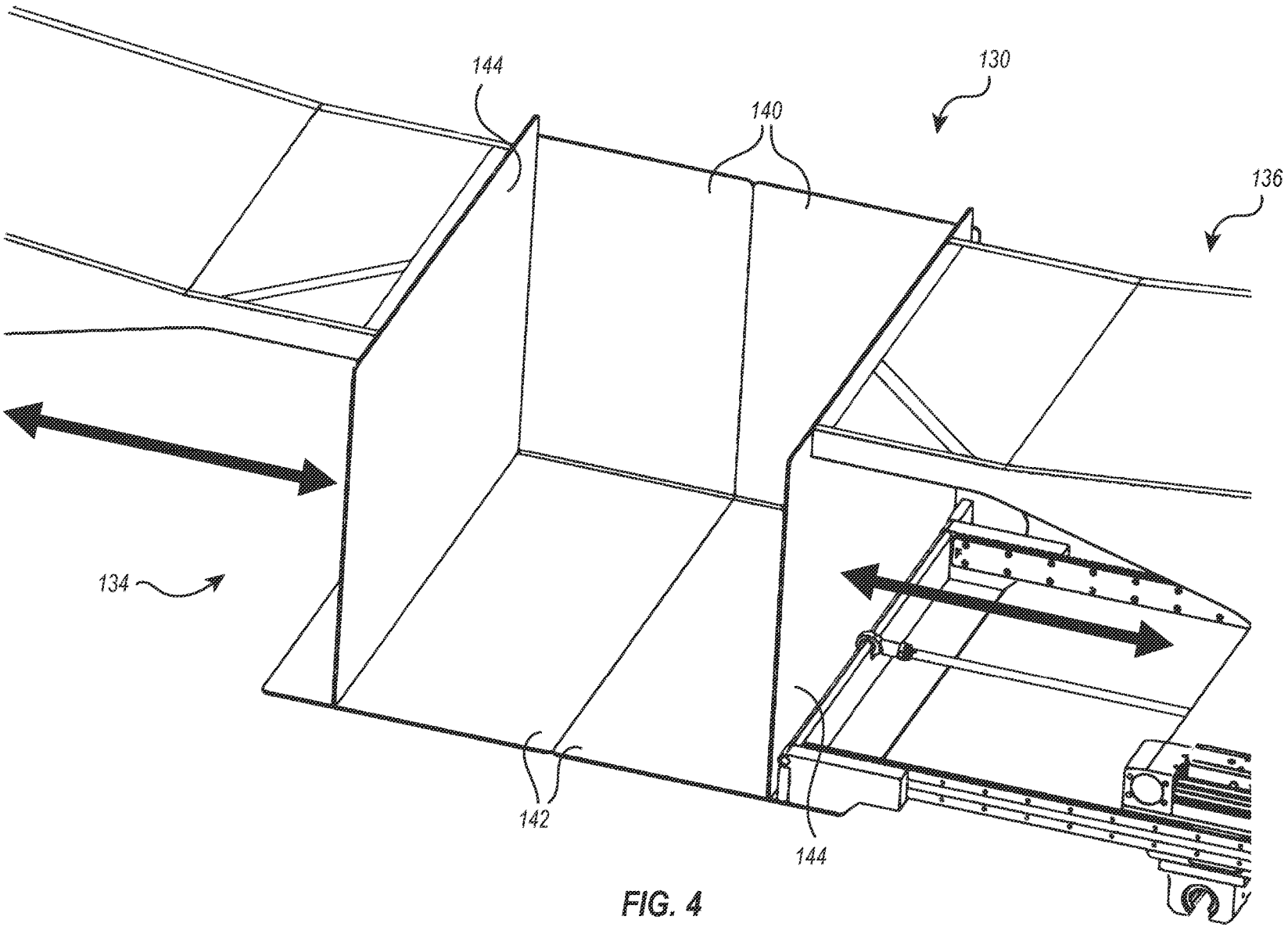
FIGS. 4-7 illustrate various views of the crowder assembly of FIG. 3.
Figure 5:
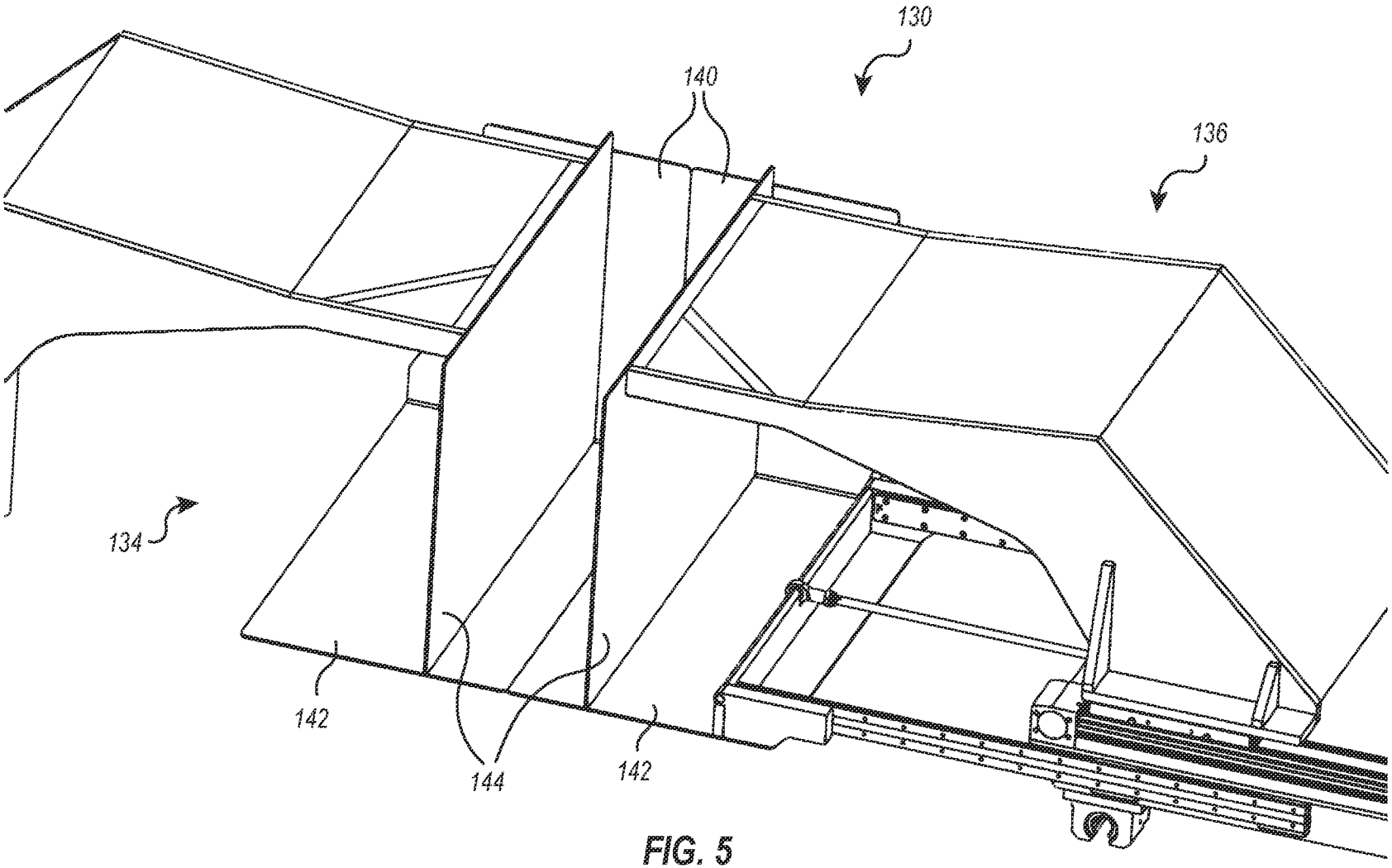

The sidewalls 144 may move relative to one another and relative to the back wall 140 and the floor 142 of the corresponding half. For instance, a comparison between FIGS. 4 and 5 shows the sidewalls 144 at different positions relative to one another and relative to the back walls 140 and the floors 142. In FIG. 4, the sidewalls 144 are spaced apart so that a stack of items may be delivered into the crowder assembly 130 between the sidewalls 144. Once the stack of items is position within the crowder assembly 130 (e.g., above floors 142 and between sidewalls 144), the sidewalls 144 may be moved towards one another (and relative to back walls 140 and floors 142) and towards the stack disposed therebetween until the sidewalls 144 are positioned against or adjacent to the stack of items.

Figure 6:
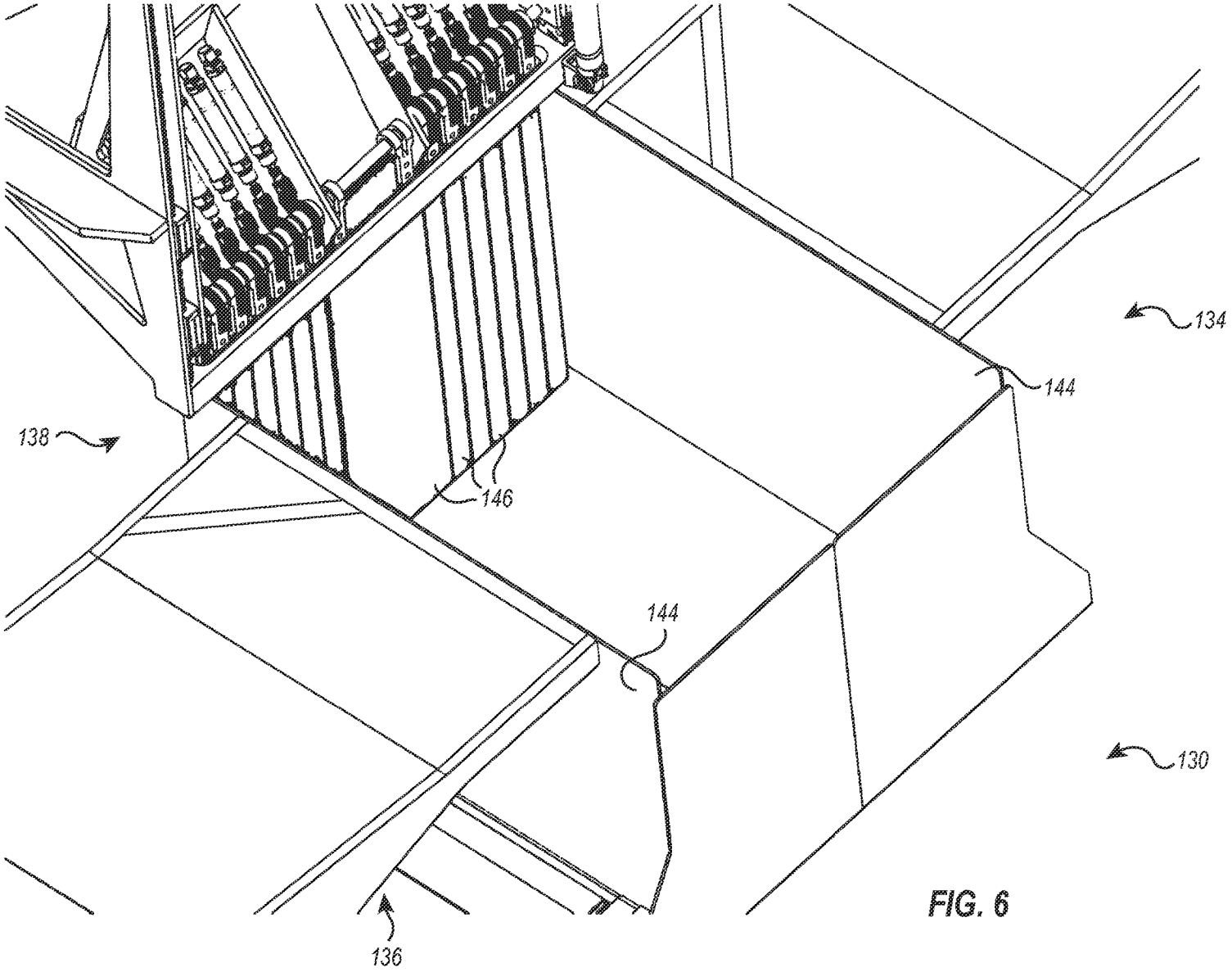
Figure 7:
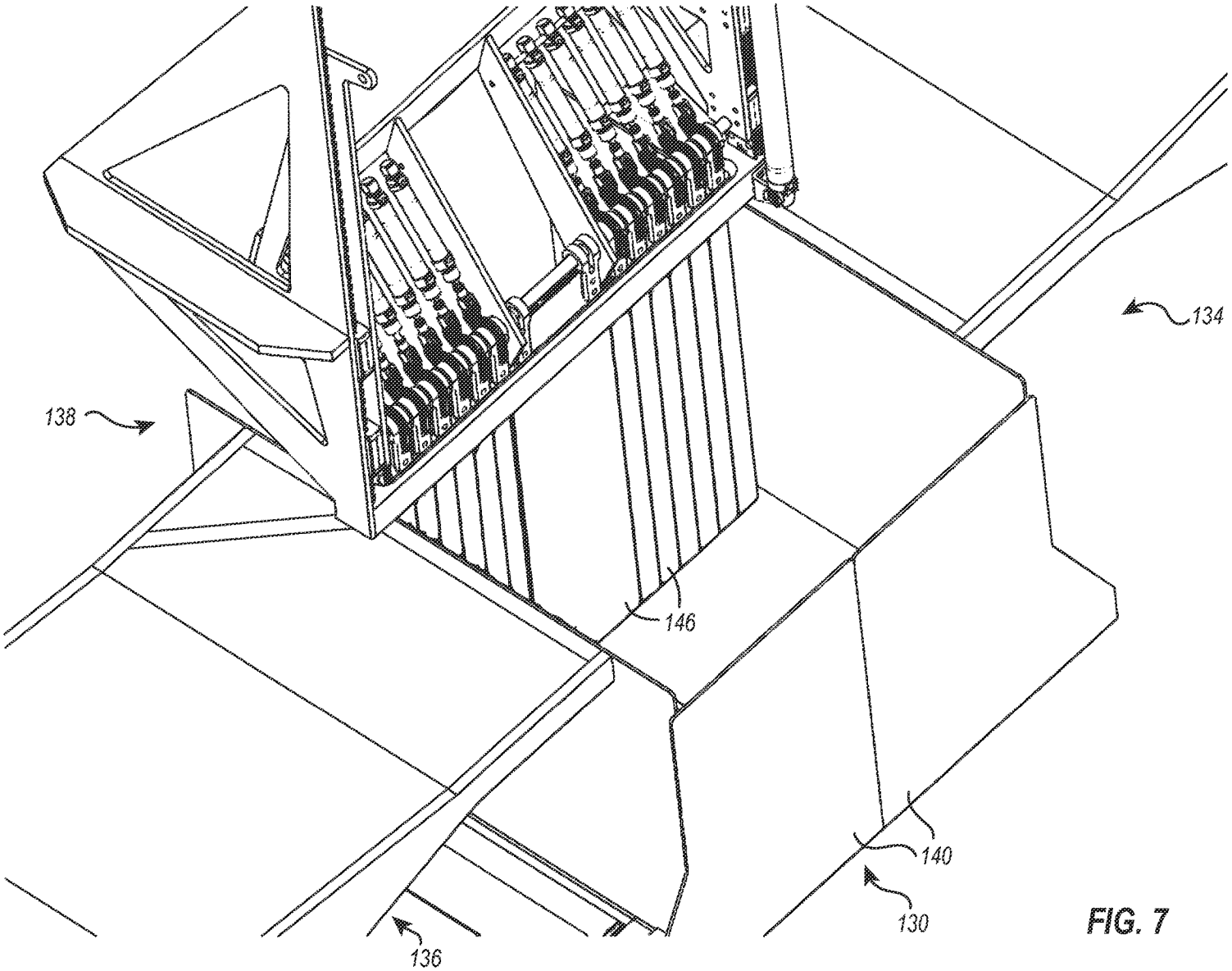

Once the sidewalls 144 are positioned against or adjacent to the stack of items, the front wall assembly 138 may be lowered between the side walls 144 and moved towards the stack of items. For instance, FIGS. 6 and 7 illustrate a rear perspective view of the crowder assembly 130 with the front wall assembly 138 lowered.

In the illustrated embodiment, the front wall assembly 138 includes a plurality of front wall sections 146 that may be individually lowered to create a front wall for the crowder assembly 130. The number of front wall sections 146 that are lowered may be determined by the distance between the sidewalls 144 (which is determined by the width of the stack of items within the crowder assembly 130). In some embodiments, some of the front wall sections 146 have similar widths while one or more of the front wall sections 146 have a width that is different than the rest of the front wall sections 146. For example, as shown in FIGS. 6 and 7, a center front wall section 146 has a width that is wider than the rest of the front wall sections 146. In some embodiments, the center front wall section 146 has a width of about eight inches while the rest of the front wall sections 146 have a width of about 1 inch each.

Once the proper number of front wall sections 146 are lowered between the sidewalls 144 (e.g., to span the gap between the sidewalls 144), the front wall assembly 138 may be moved towards the back walls 140 until the front wall sections 146 are positioned against or adjacent to the stack of items disposed within the crowder assembly 130. By moving the sidewalls 144 towards one another and the front wall assembly 138 towards the back walls 140, the crowder assembly 130 contains the stack of items therein in the configuration arranged in step 104. As discussed in greater detail below, with the stack contained within the crowder assembly 130 as described, a box template can be folded around the crowder assembly to package the items therein within the packaging template.

It will be noted that while the crowder assembly 130 has been described and illustrated as having two halves that are mirror images, this is only exemplary. For instance, in some embodiments the first half 134 may have a sidewall that remains stationary relative to its corresponding back wall 140 and floor 142. In such an embodiment, the sidewall of the second half may only move towards the stationary sidewall of the first half (even moving over the floor 142 of the first half). Similarly. The front wall sections may also be arranged so that a wider front wall section is positioned closer to the stationary sidewall of the first half. In other words, the crowder assembly may be configured to justify everything to one side thereof, such that the stack of items is positioned towards one side of the crowder assembly rather than being centered therein as in the illustrated embodiment.

Figure 8:
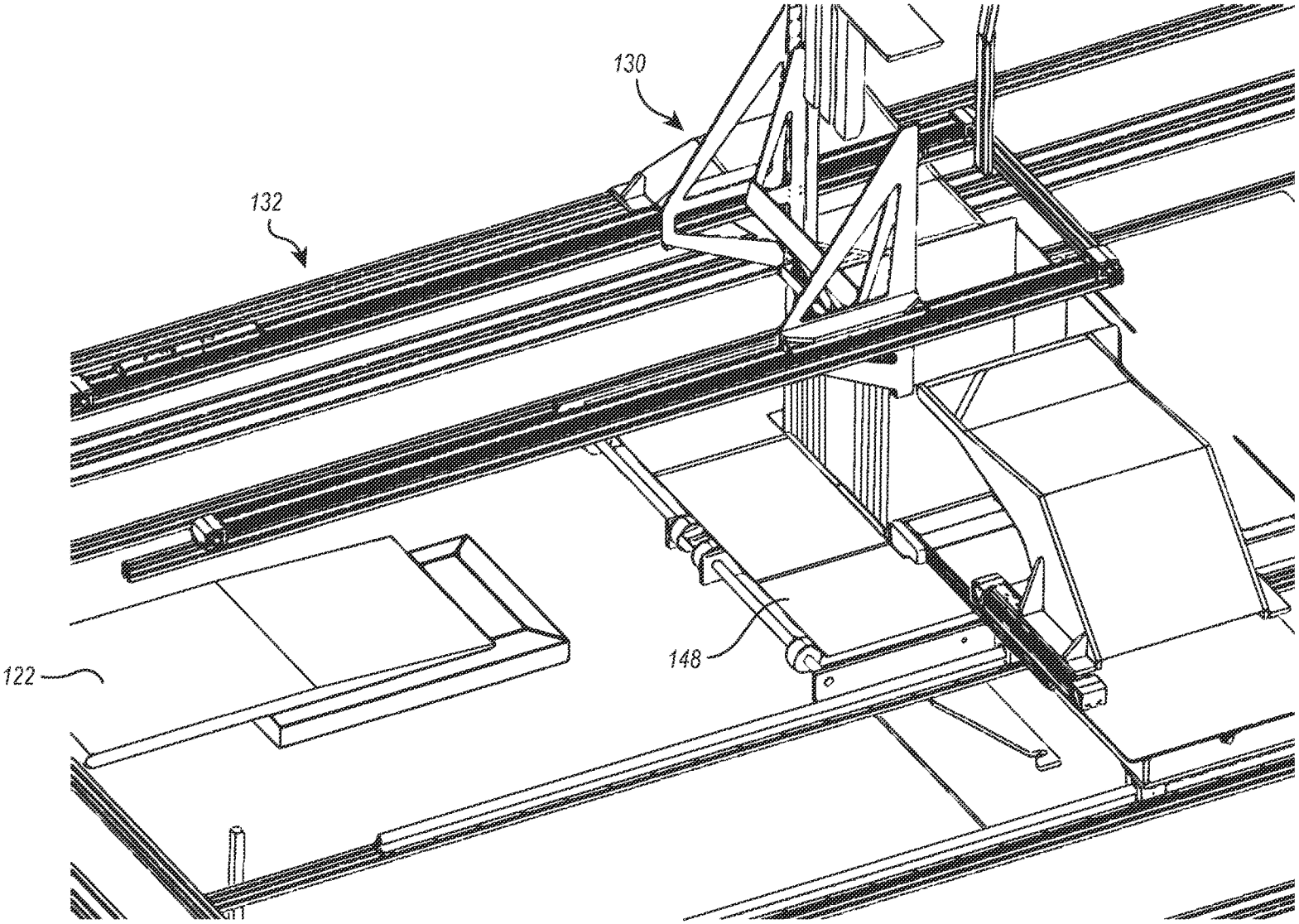
FIGS. 8-24 illustrate mechanisms and process steps for forming a box around item(s) in the crowder assembly to package the item(s).

Once the stack of items is securely position within the crowder assembly 130 (e.g., positioned on floor(s) 142 and between opposing sidewalls 144, back wall(s) 140, and front wall sections 146), the crowder assembly 130 may move along a frame structure 132 towards a packaging station, as shown in FIG. 8. At the packaging station, a box template 148 may be advanced underneath the crowder assembly 130 and/or the crowder assembly 130 may be advanced over the top of the box template 148.

The box template 148 may be formed or created by the converting assembly that is part of or separate from the packaging machine 124. The converting assembly may form cuts and/or creases in the template material to form box template 148. The cuts and creases may form various panels and flaps of the box template 148 and facilitate folding of the box template 148 around the stack of items.

Figure 9:
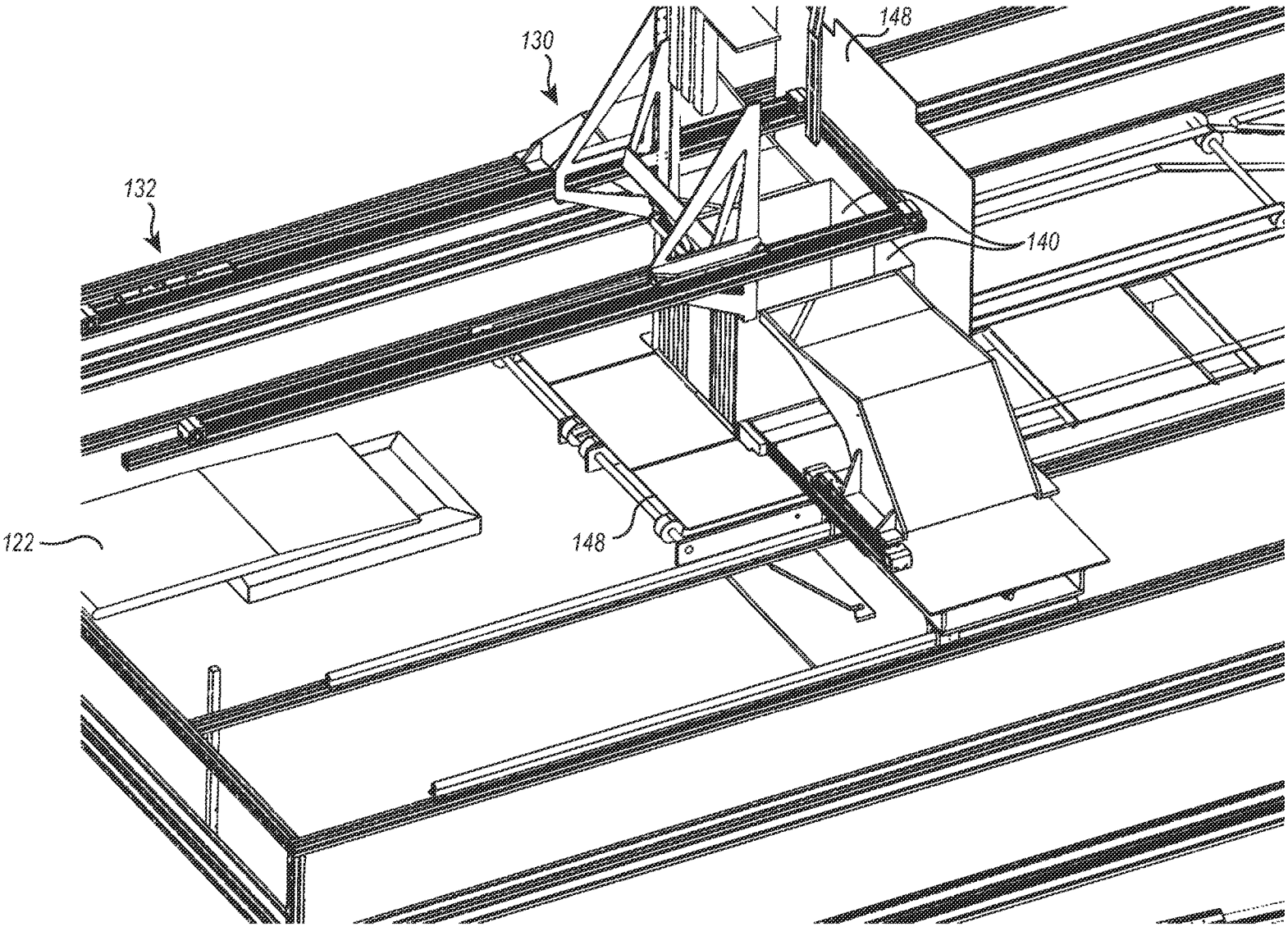
Figure 10:
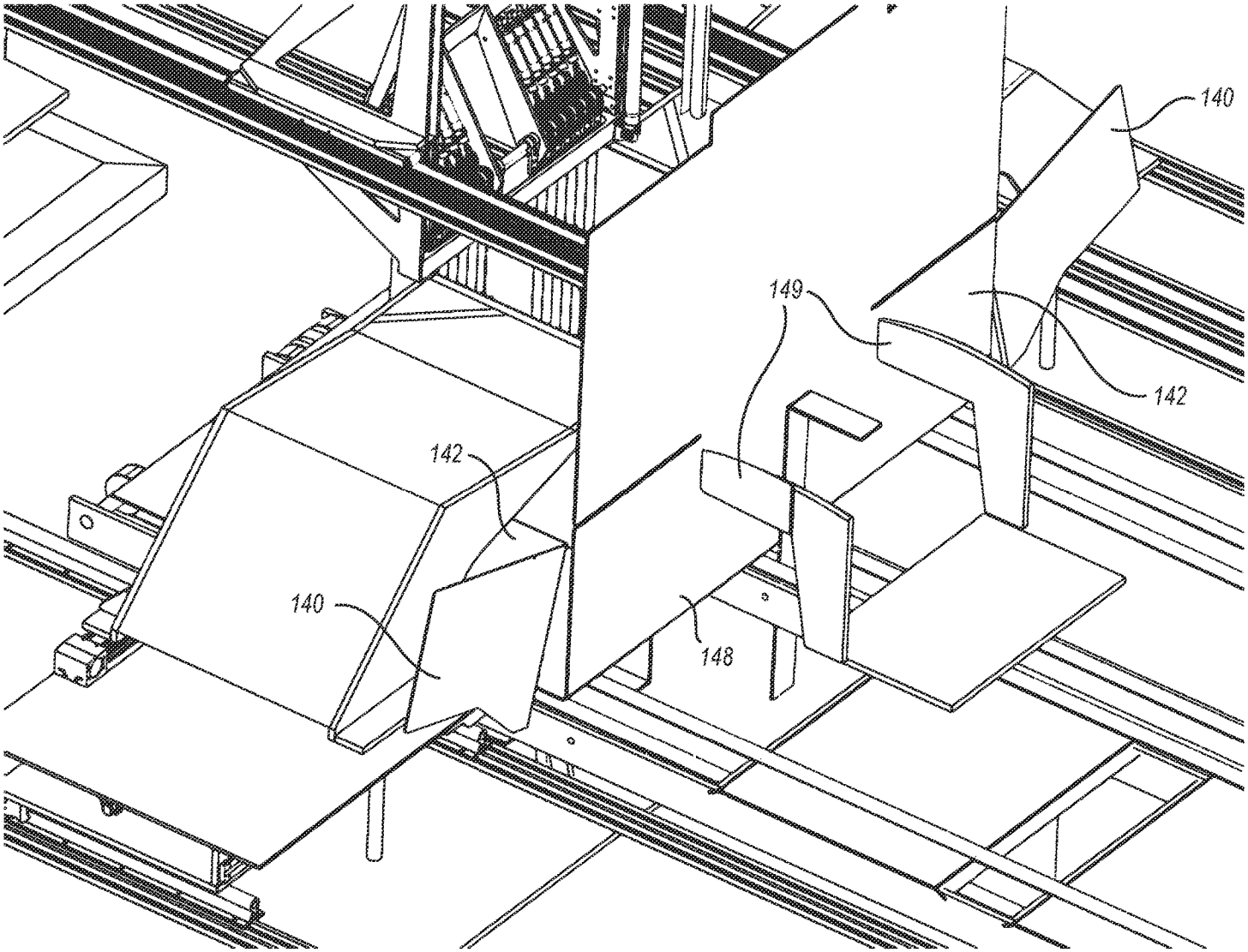

FIGS. 9-24 illustrate example steps for folding the box template 148 around the stack of items. As shown in FIG. 9, the box template is folded up against the back walls 140 of the crowder assembly 130. With box template 148 positioned below the crowder assembly 130 and box template 148 folded up against the back walls 140, the back walls 140 and floors 142 of the crowder assembly 130 can be withdrawn or retracted away from the stack of items, as shown in FIG. 10. When back walls 140 and floors 142 are withdrawn or retracted, the stack of items is deposited on top of a panel of the box template 148 and the folded portion of the box template 148 replaces the back walls 140, as shown in FIG. 10.

In some embodiments, such as that illustrated in FIG. 10, when back walls 140 and floors 142 are withdrawn or retracted, back walls 140 and floors 142 are rotated away from the stack of items. Rotation of the back walls 140 and floors 142 can provide additional clearance for subsequent steps of folding the packaging template 148 around the stack of items.

FIGS. 11-24 illustrate additional folds being formed in the box template 148 to fold the box template 148 around the stack of items. In particular, various folding mechanisms are used to fold flaps and panels of the box template 148 around the stack of items. The folding mechanisms may take any of a variety of forms. For instance, the folding mechanisms may be arms, levers, or other mechanisms that can be moved relative to the box template 148 and/or relative to which the box template 148 may be moved in order to fold the flaps and/or panels of the box template 148 around the stack of items.

Figure 11:
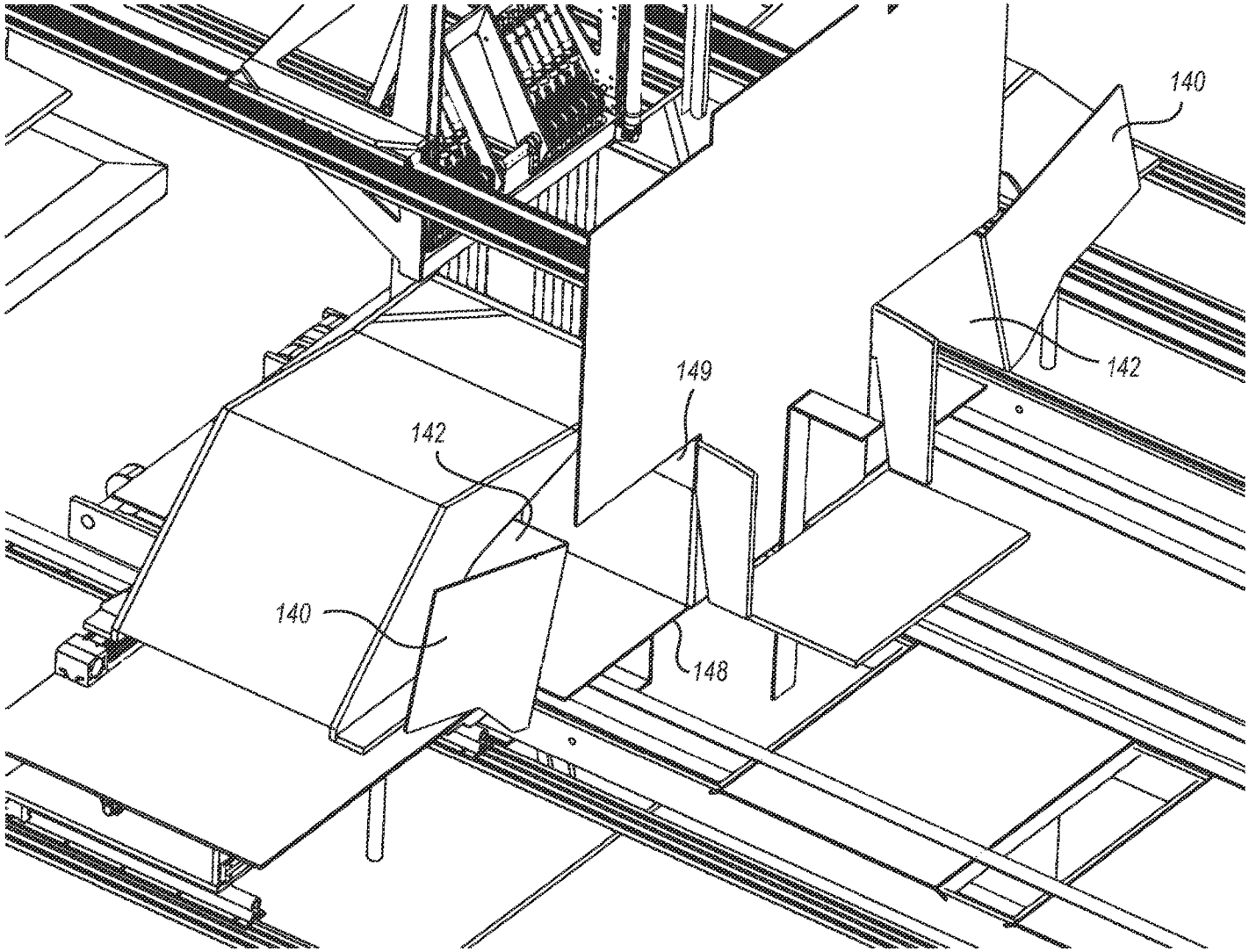

For instance, as can be seen when comparing FIGS. 10 and 11, folding bars 149 can be used to fold flaps of the box template 148 that will at least partially form sidewalls of the resulting box. To fold the panels with the folding bars 149, the folding bars 149 can be moved relative to the box template 148 so as to engage the panels of the box template 148 and fold them towards the stack of items. Additionally, or alternatively, the box template 148 (with the stack of items thereon) can be moved towards the folding bars 149 so as to engage the panels of the box template 148 and fold them towards the stack of items.

Figure 12:
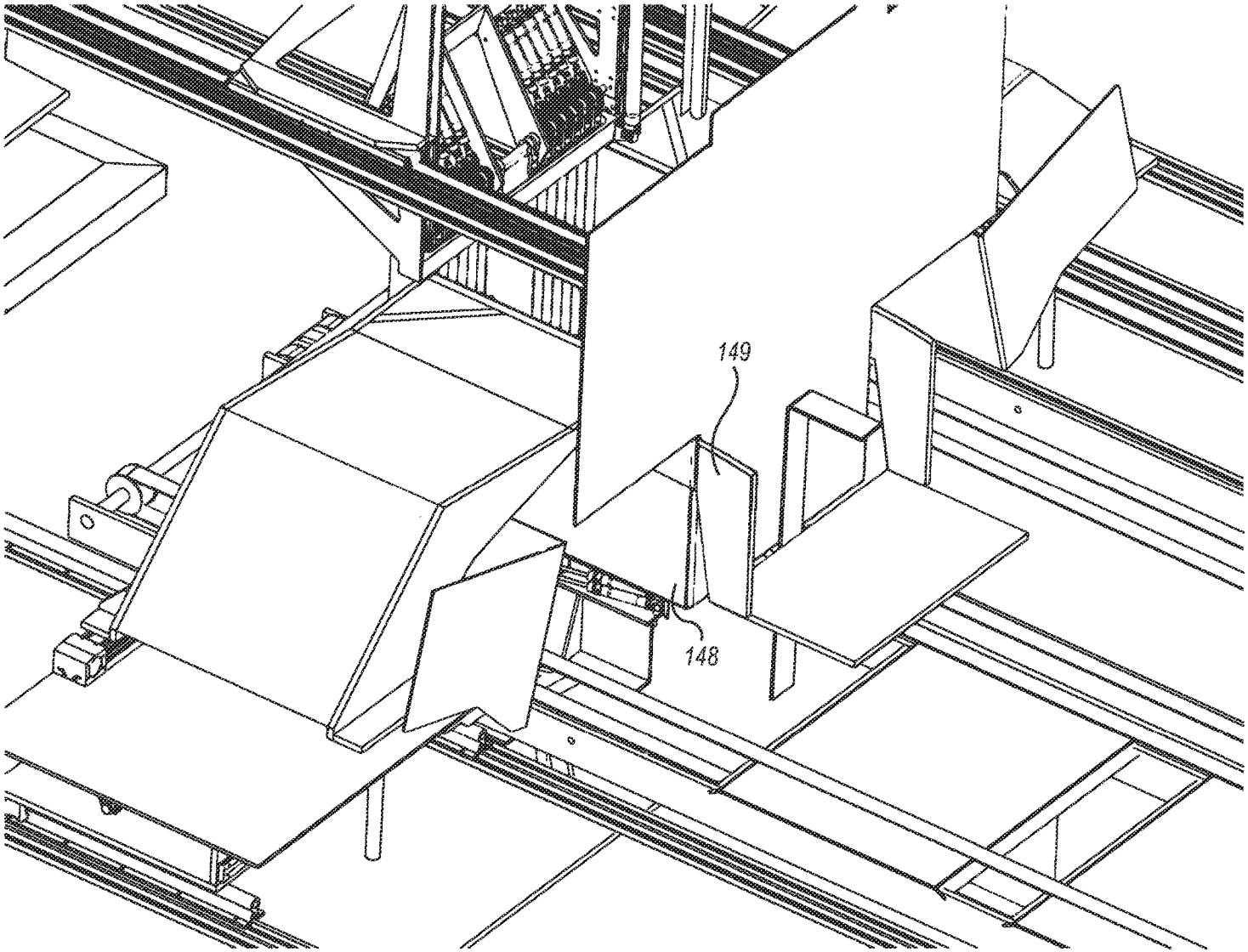

Thereafter, as shown in FIG. 12, additional panels of the box template 148 can be folded up to form at least portions of the sidewalls of the resulting box. The additional sidewall panels can be folded up with folding arms 151 (one of which is shown in FIGS. 13-21).

Figure 13:
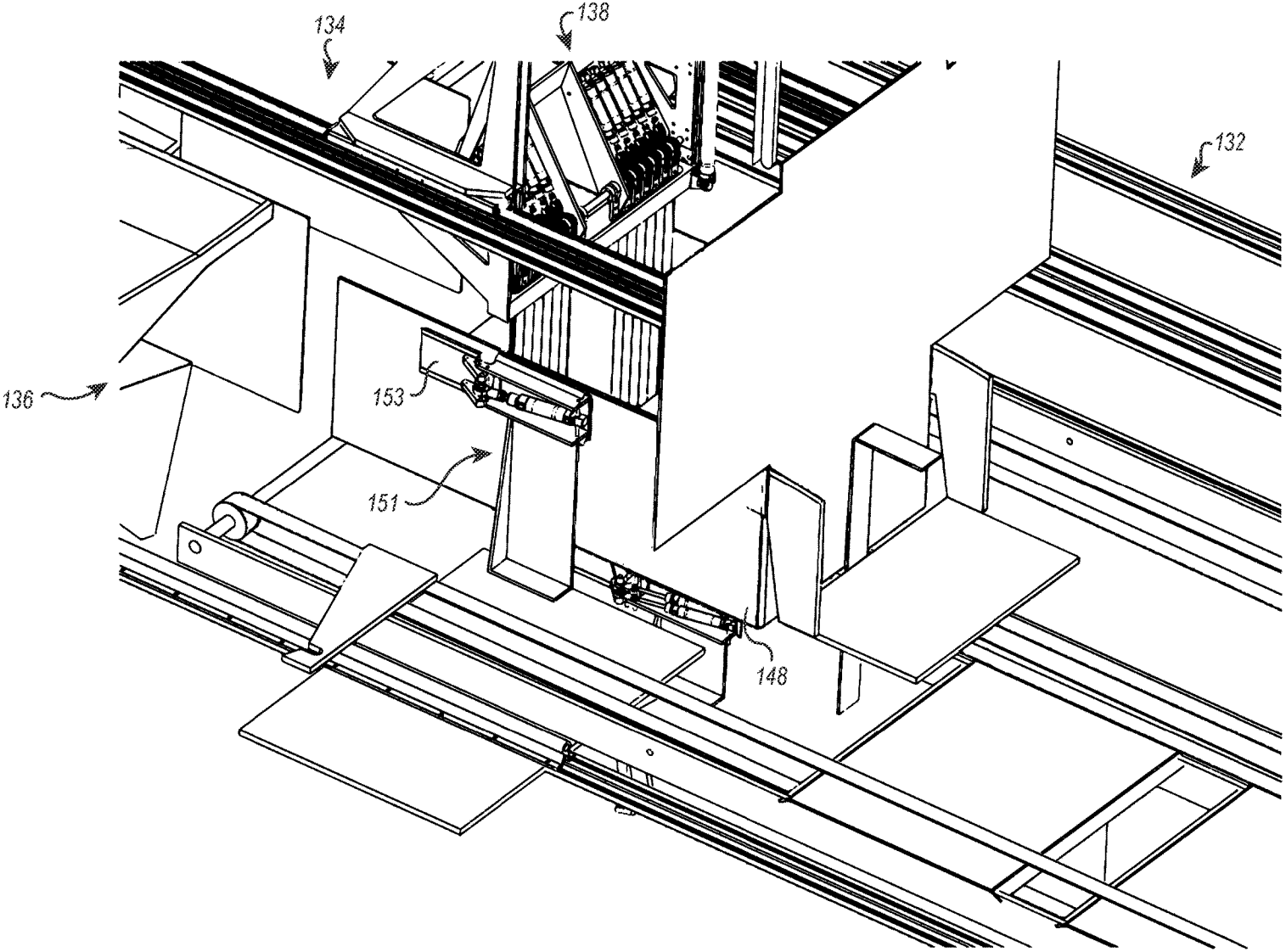
Figure 14:
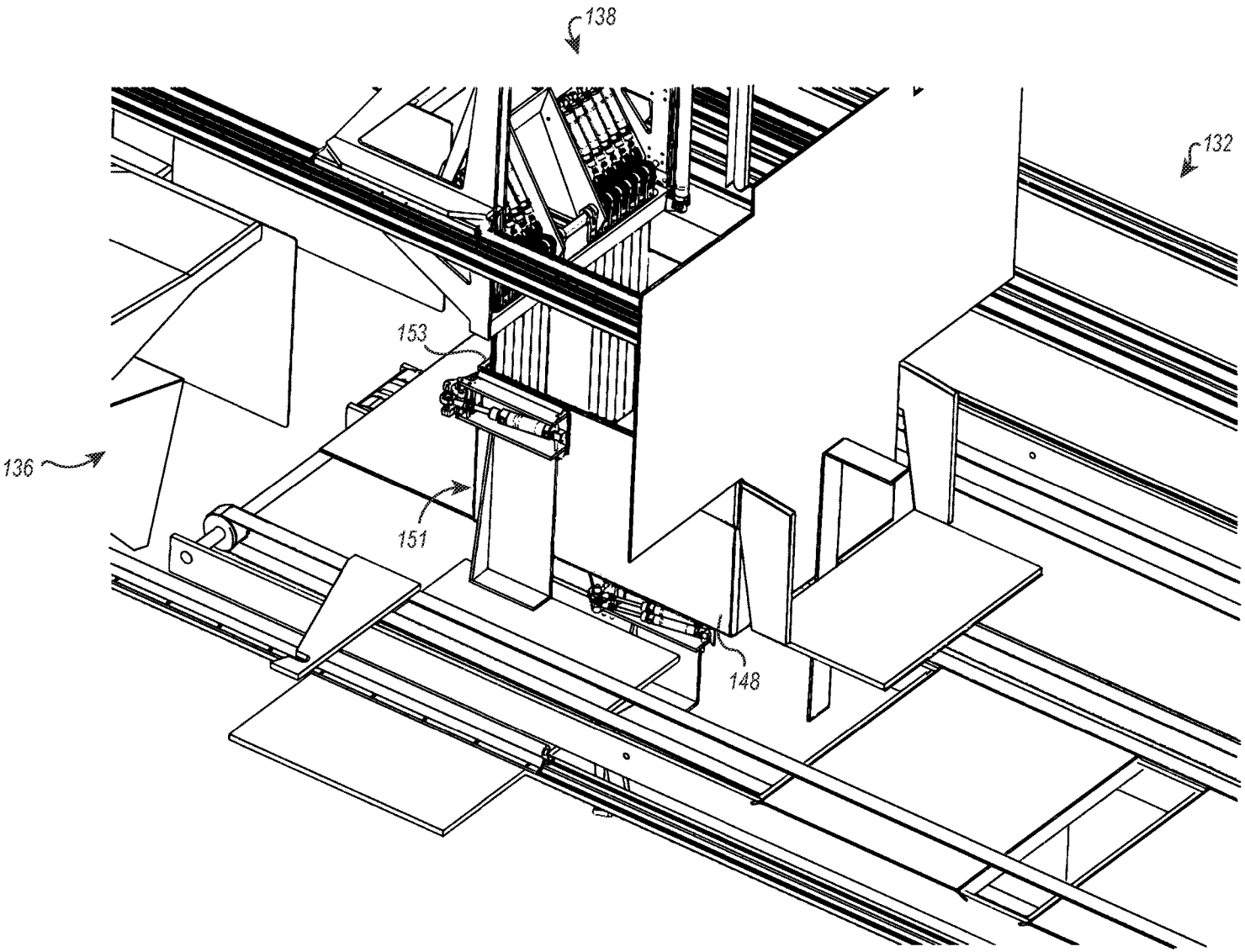

As shown in FIG. 13, after some of the folds are formed the in the box template 148, the first half 134 and the second half 136 of the crowder assembly 130 are moved along the frame structure 132 back towards the conveyor 122 in preparation for receiving another stack of items. Notably, as also shown in FIG. 13, the front wall assembly 138 can remain positioned adjacent to the stack of items even after the first half 134 and the second half 136 of the crowder assembly 130 are moved back towards the conveyor 122. The front wall assembly 138 can remain in place as shown in FIGS. 13 and 14 while additional folds are made to the packaging template 148 to create a front wall from the packaging template 148 to contain the stack of items.

At least portions of the front wall of the box can be formed using folding levers 153, one of which is shown in FIGS. 13-21. In the illustrated embodiment, folding levers 153 are connected to folding arms 151. In some embodiments, one or more actuators can be connected to folding levers 153. Activation of the actuators can cause folding levers 153 to pivot or otherwise move to fold additional panels of the box template 148.

Figure 15:
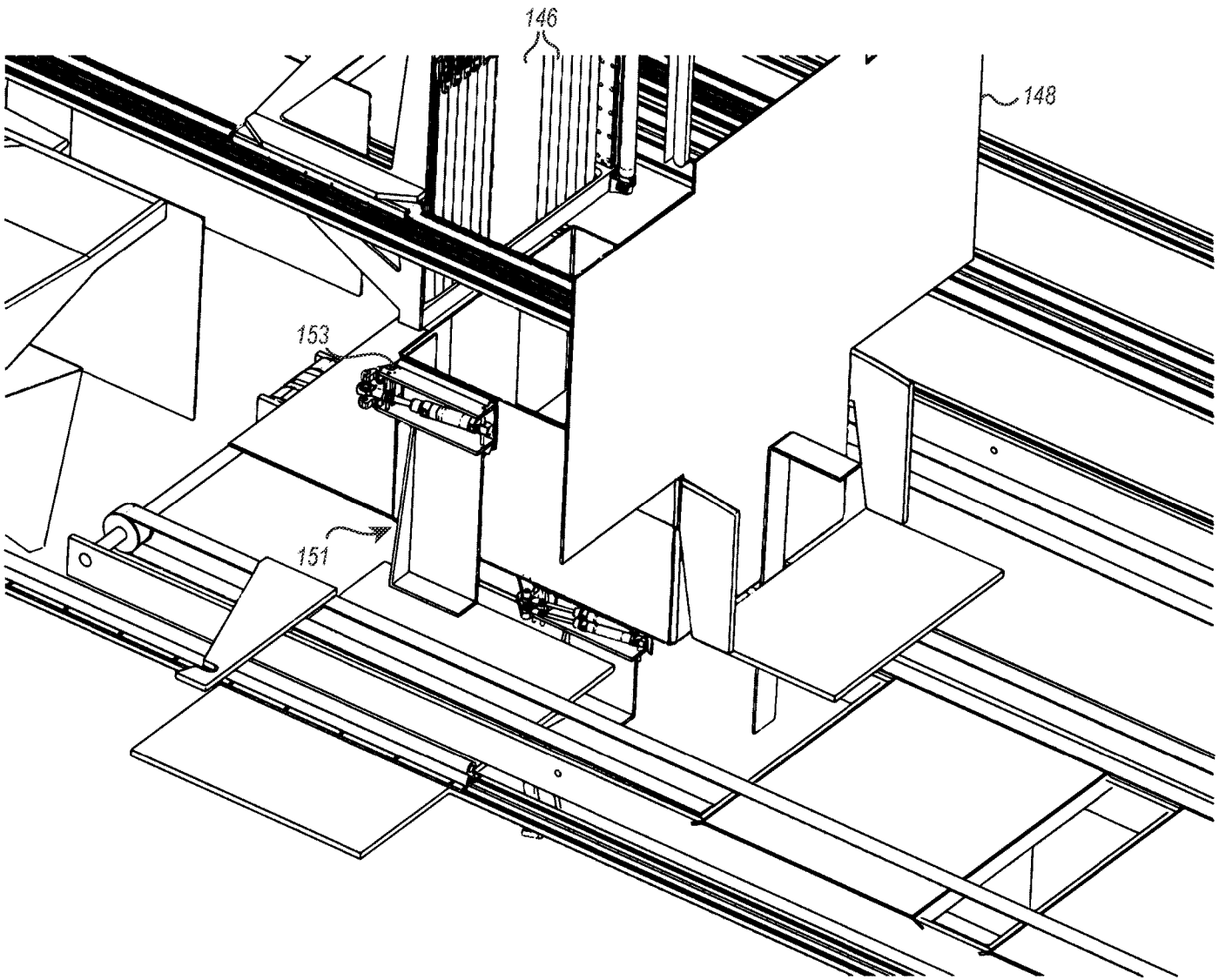
Figure 16:
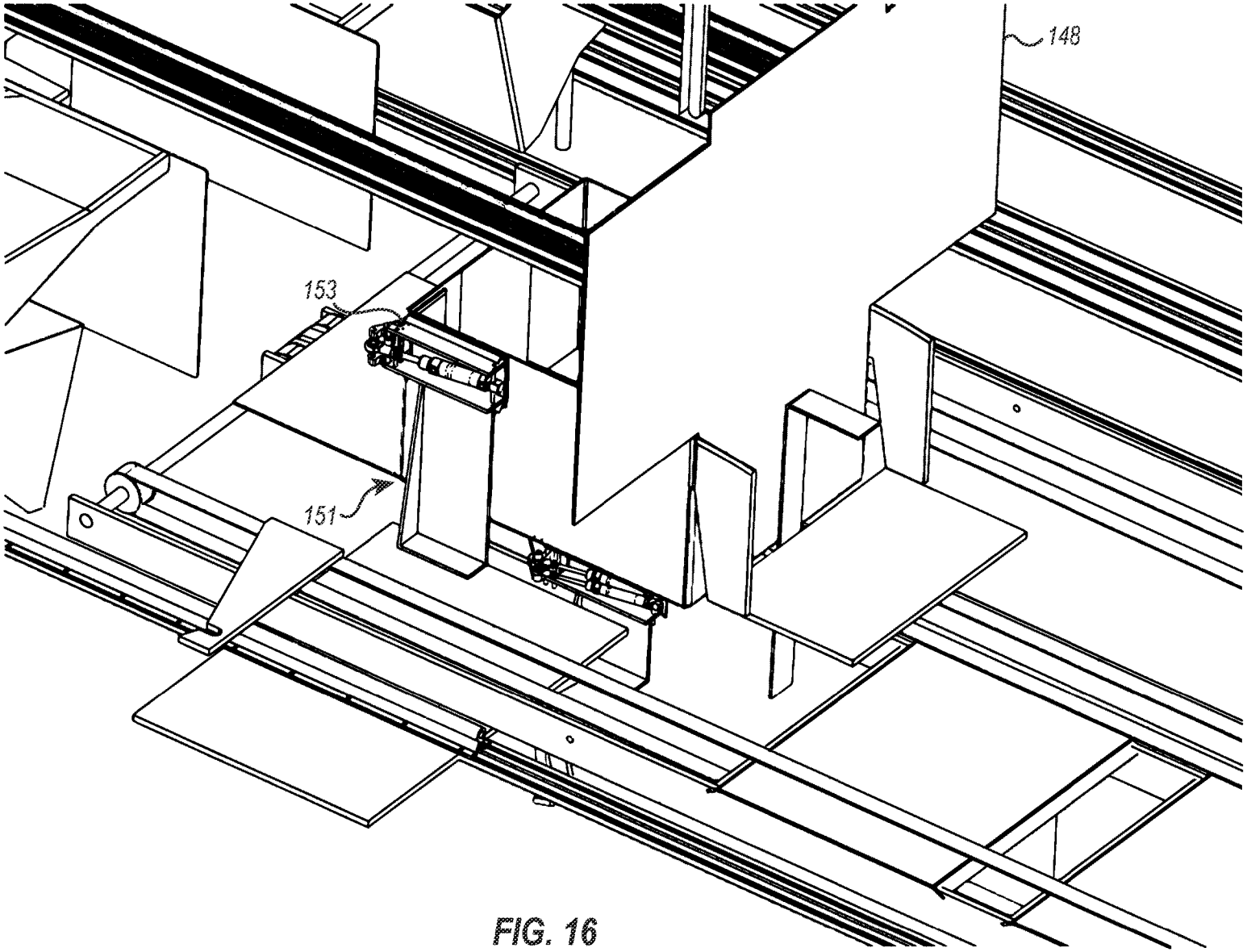

Once a front wall has been at least partially formed with the packaging template 148, as shown in FIG. 15, the front wall sections 146 can be raised and removed from between the stack of items and the front wall of the box partially formed by the box template 148. Thereafter, the front wall assembly 138 can move along frame structure 132 back towards conveyor 122 in preparation for another stack of items.

Figure 17:
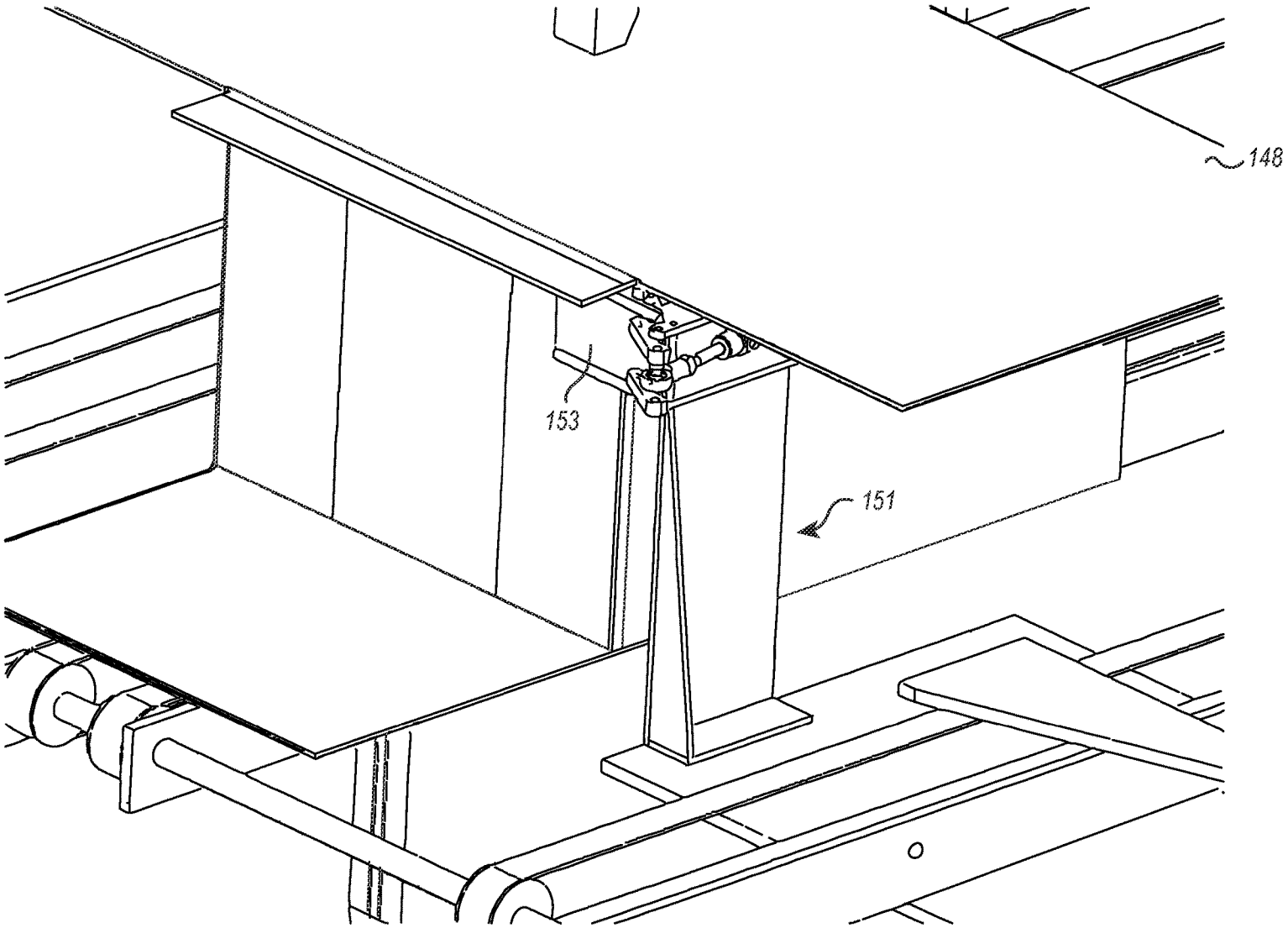
Figure 18:
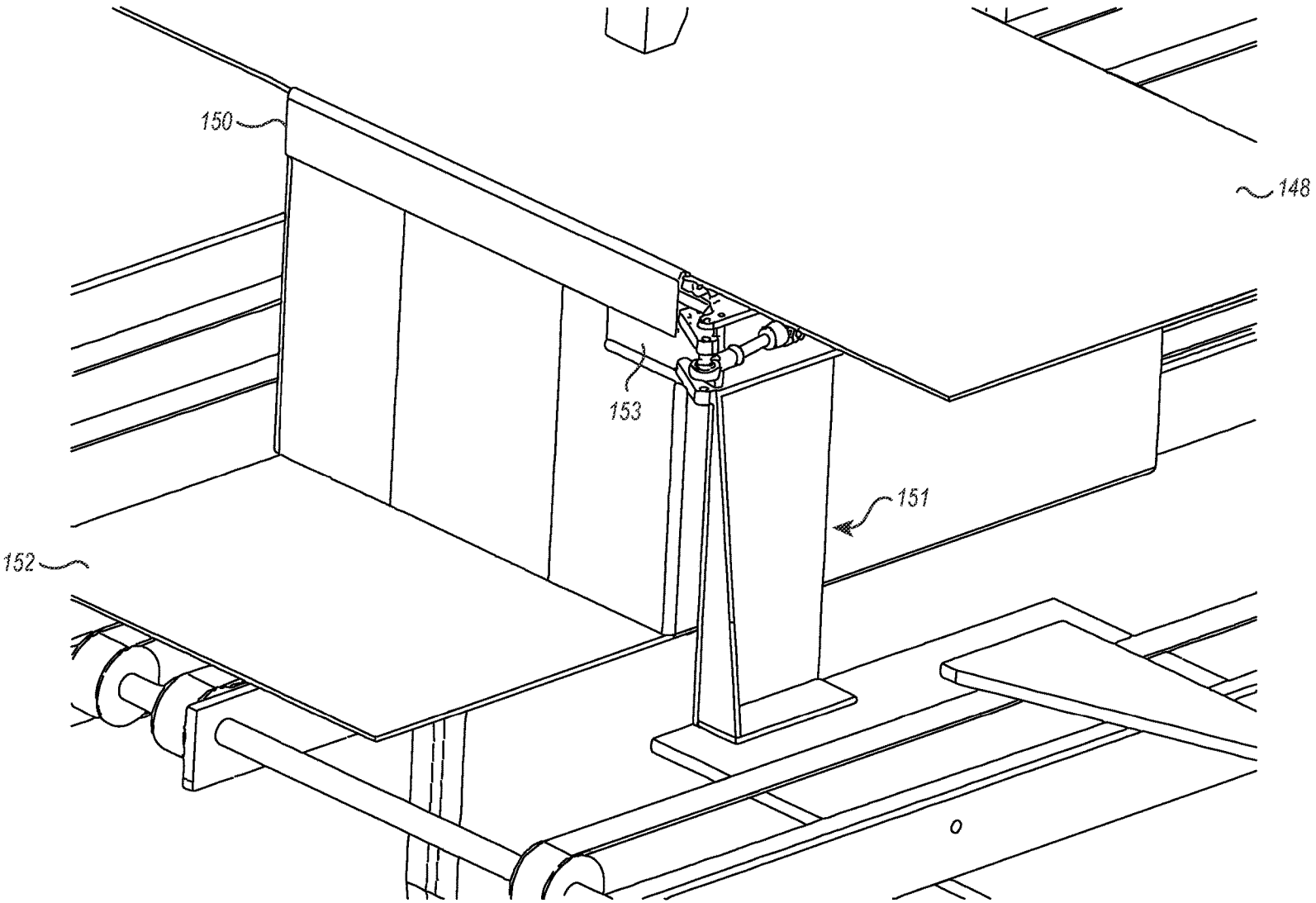

With the front wall assembly 132 removed, additional folds can be made to the box template 148 as shown in FIGS. 17-24. For instance, as shown in FIG. 17, a portion of the box template 148 can be folded down towards the stack of items to form a top surface of the resulting box. This can be done with one or more stationary or movable folding arms. Additionally, one or more folding arms can fold down the glue tab 150 of the box template 148, as shown in FIG. 18.

Figure 19:
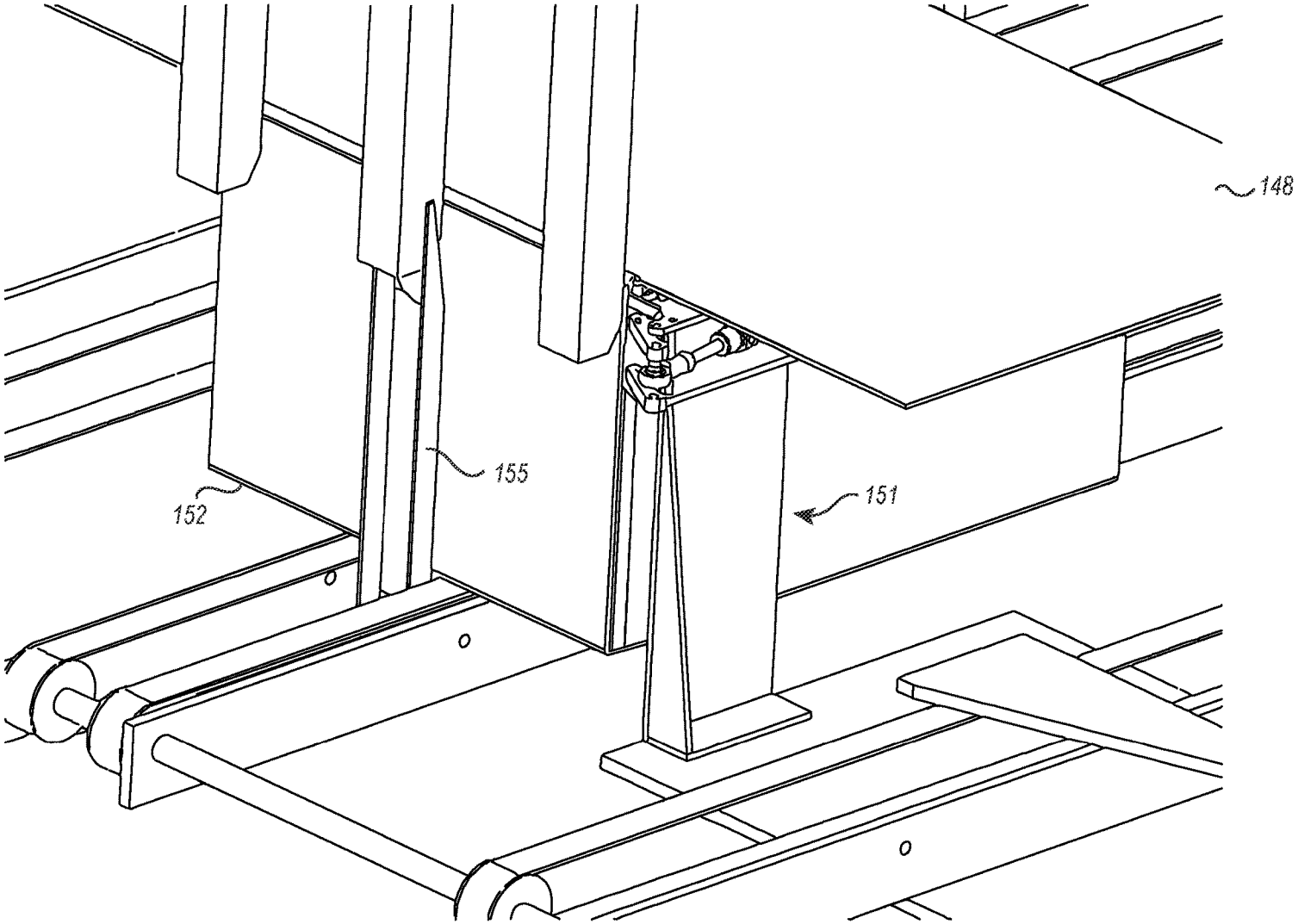
Figure 20:
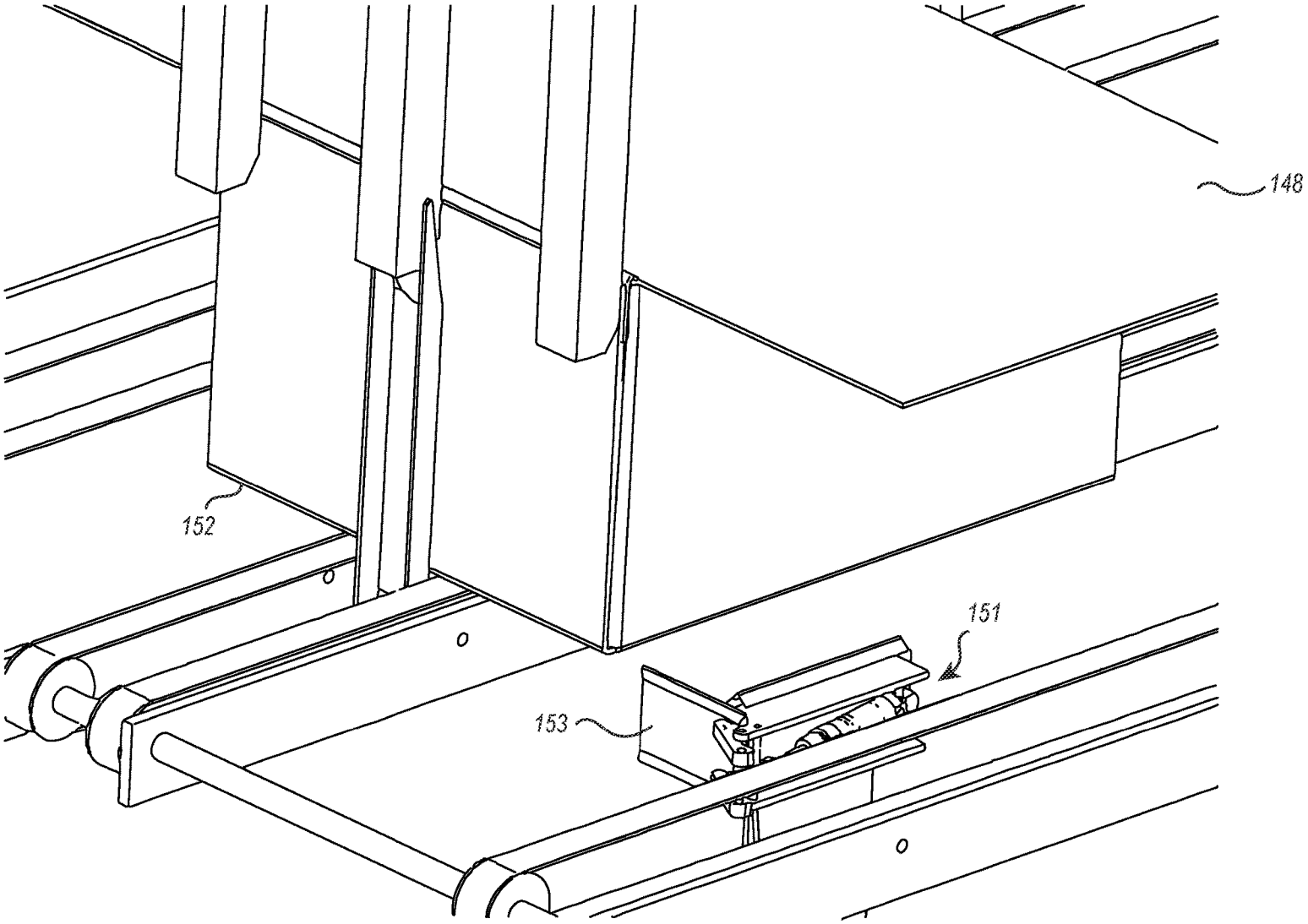

Once the box template 148 is folded around the stack of items as shown in FIG. 18, glue can be applied to a glue tab 150 and/or a panel 152 of the box template 148. Thereafter, the panel 152 can be folded towards the glue tab 150 via folding bar 155, as shown in FIG. 19. The glue can secure the panel 152 to the glue tab 150 together. With the panel 152 and the glue tab 150 secured together, a partially formed box formed by the box template 148 is at least partially secured around the stack of items. At this stage, folding arms 151 and folding levers 153 may be withdraw or retracted, as shown in FIG. 20.

Figure 21:
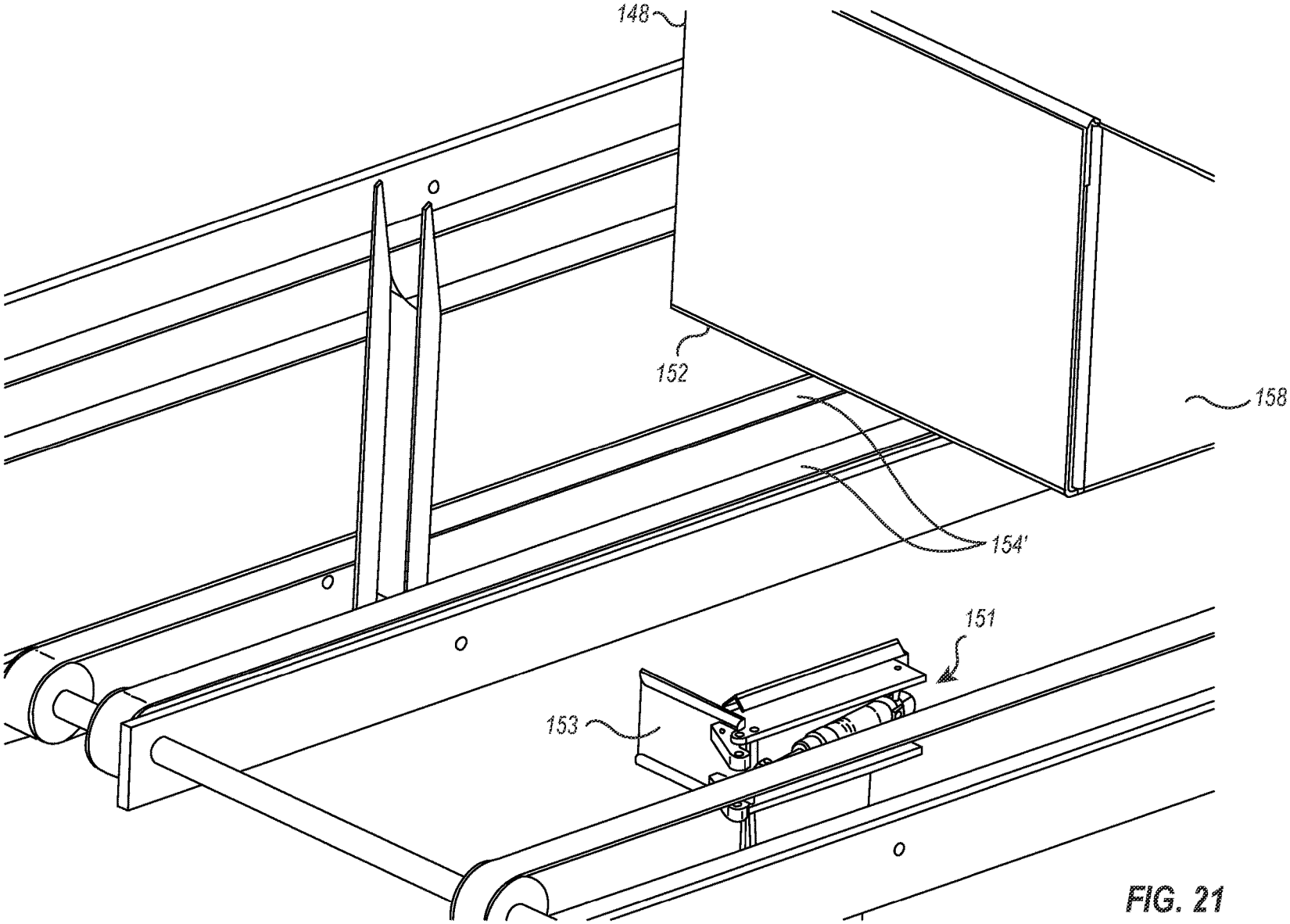
Figure 22:
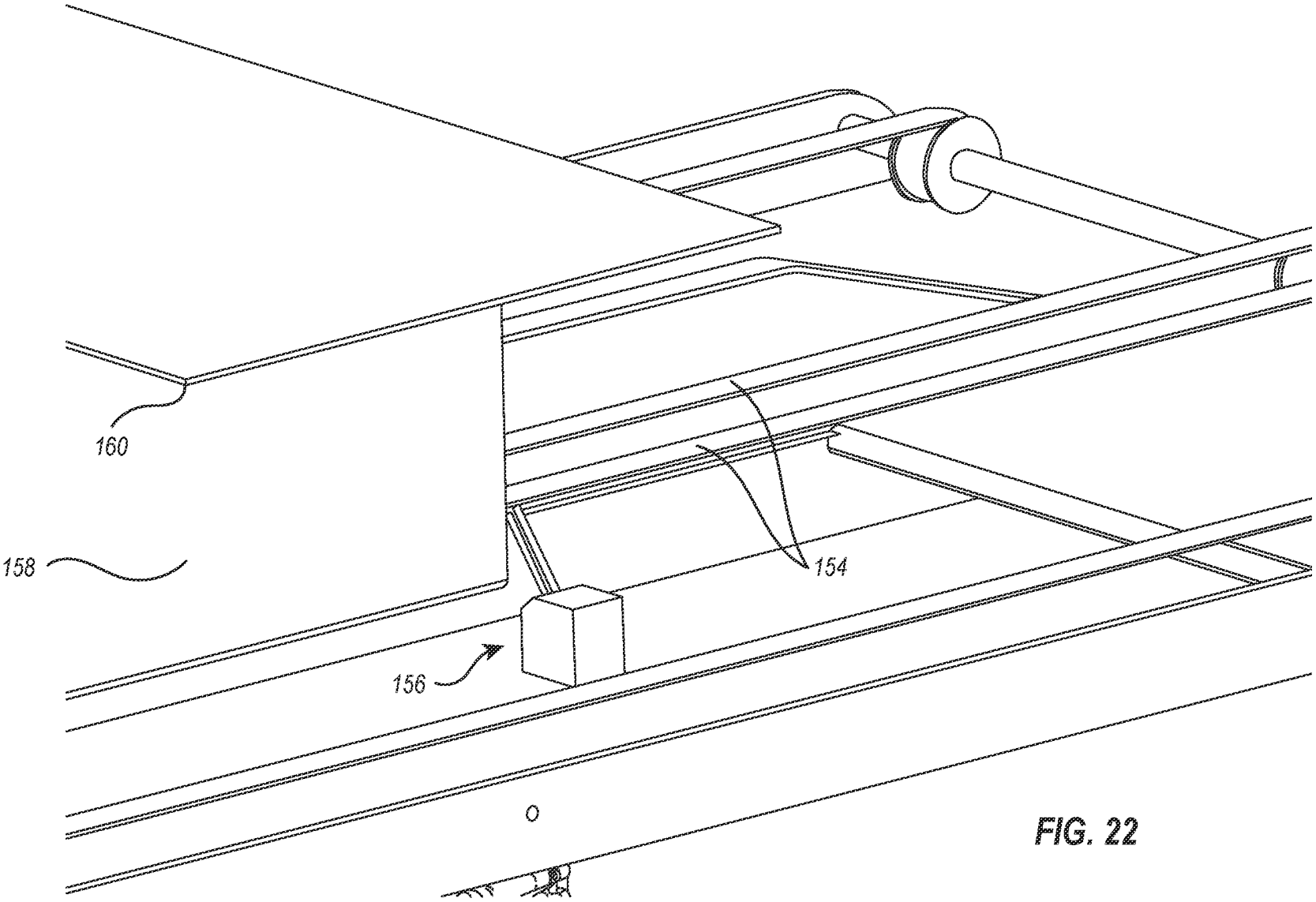
Figure 23:
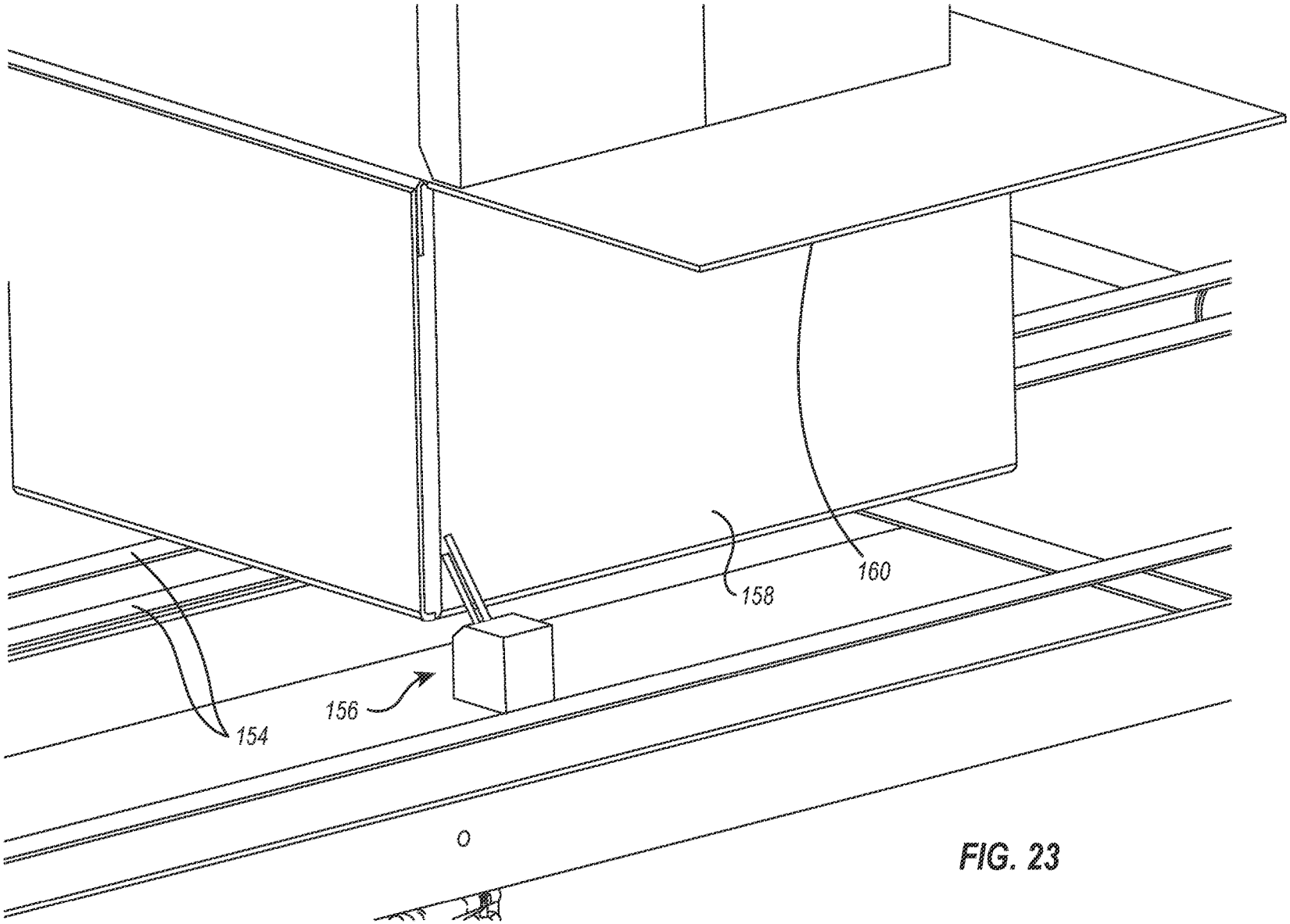

The partially formed box (containing the stack of items) can then be advanced via conveyors 154 (or other mechanisms) as shown in FIG. 21-23. As the partially formed box moves along conveyors 154, the partially formed box moves past glue applicators 156 (as shown in FIGS. 22 and 23) on opposing sides thereof (only one glue applicator 156 is shown). The glue applicators 156 apply glue to one or both of panels 158, 160 of the box template 148 as the partially formed box passes thereby.

Figure 24:
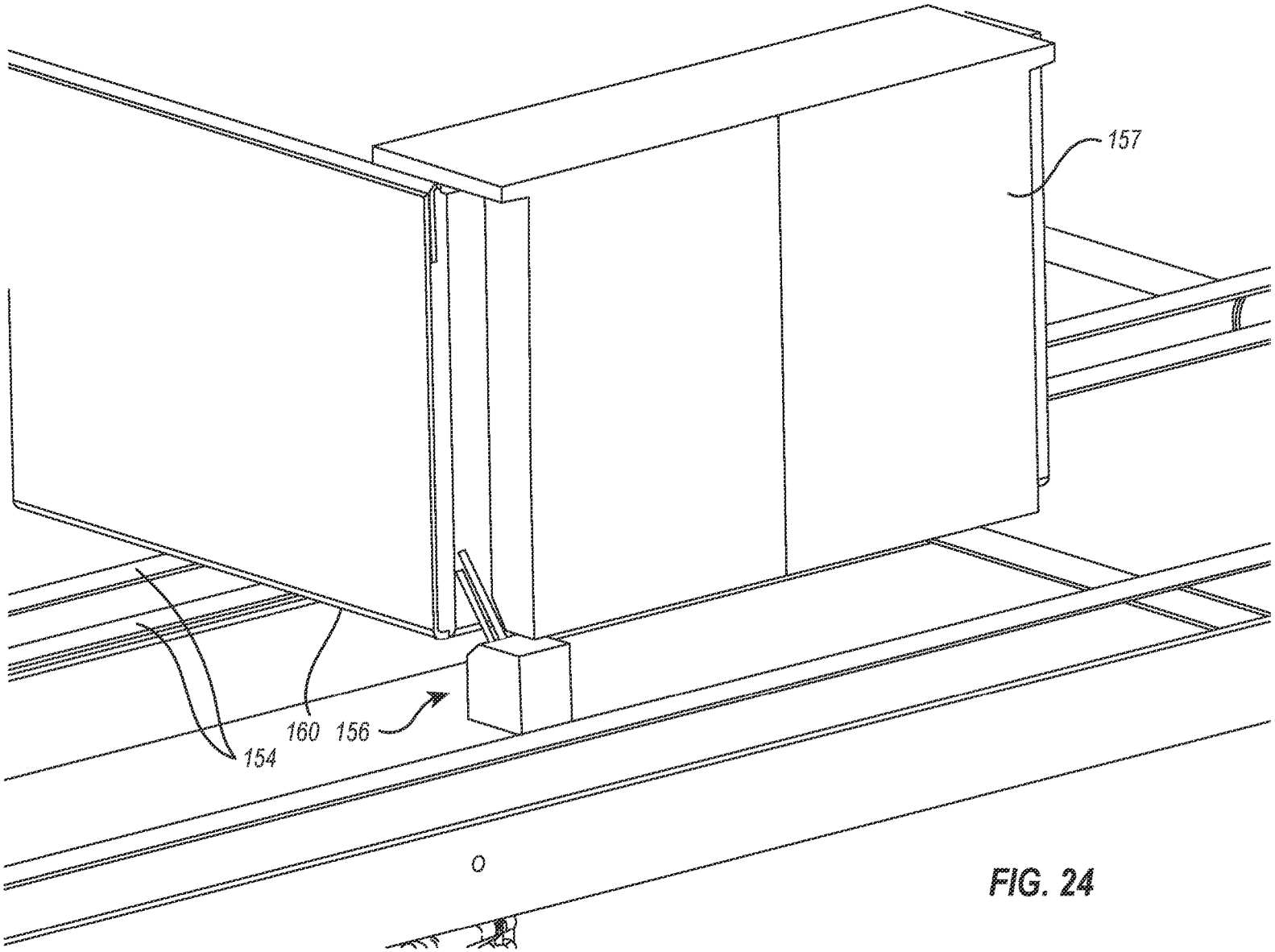
Figure 25:
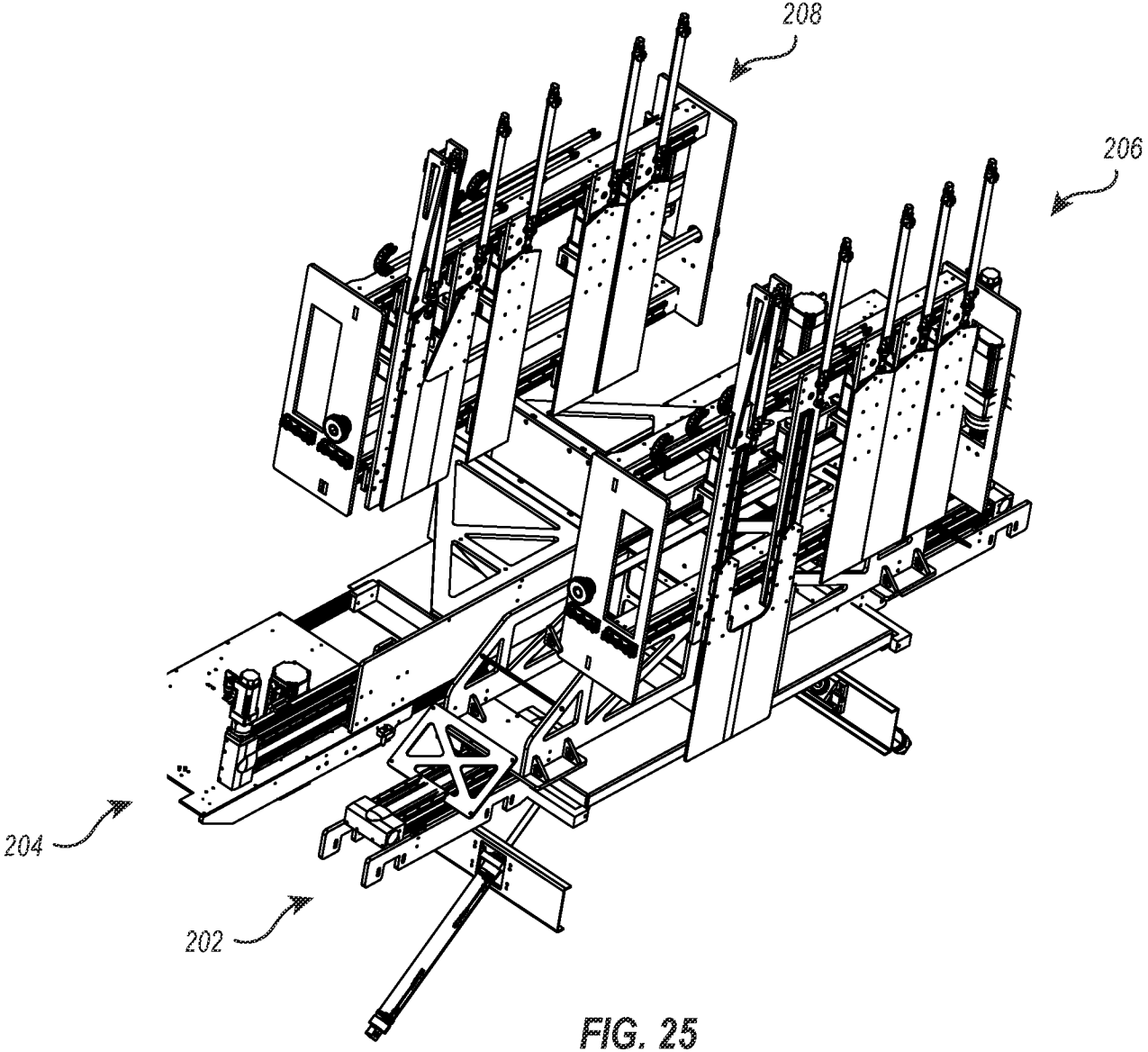
FIG. 25 illustrates a crowder assembly according to another example embodiment.

After glue is applied by the glue applicators 156, panels 160 on opposing or opposite sides of the partially formed box are folded down towards panels 158, as shown in FIG. 24. The panels 160 can be folding down by folding arms 157. The glue applied by glue applicators 156 secures panels 158, 160 together, thereby completing the formation of a box surrounding the stack of items.

While the above described and illustrated example embodiment uses gluing apparatuses and glue to attach various portions of the box template together, it will be understood that this is merely exemplary. In other embodiments, various other types of fastening apparatuses and fasteners can be used. For instance, an adhesive tape may be used to secure the various portions of the box template together. In still other embodiments mechanical fasteners (e.g., staples, clips, clamps, etc.) may be used to secure the various portions of box template together. Each of the foregoing may be considered fasteners and the apparatuses that apply them to the box template may be considered fastening apparatuses.

Once the box is fully formed and secured around the stack of items or in the process thereof, a label may be applied or printed on the box and the box can be conveyed to conveyor 126, wherein it is dispensed from or exits the packaging machine 124.

Attention is now directed to FIGS. 25-28, which illustrate another embodiment of a crowder assembly 200. In many respects, including structural and functional aspects, crowder assembly 200 may be similar or identical to crowder assembly 130 described above. Accordingly, the following discussion will focus on some of the unique aspects of crowder assembly 200, particularly when compared to crowder assembly 130.

In the illustrated embodiment, the crowder assembly 200 includes a pre-crowder 202, a crowder 204, a front wall assembly 206, and back wall assembly 208. As with the crowder assembly 130, the crowder assembly 200 is configured to maintain the stack of items in the configuration created during step 104 described above during a packaging process, including while a box template is folded and secured around the stack of items.

Figure 26:
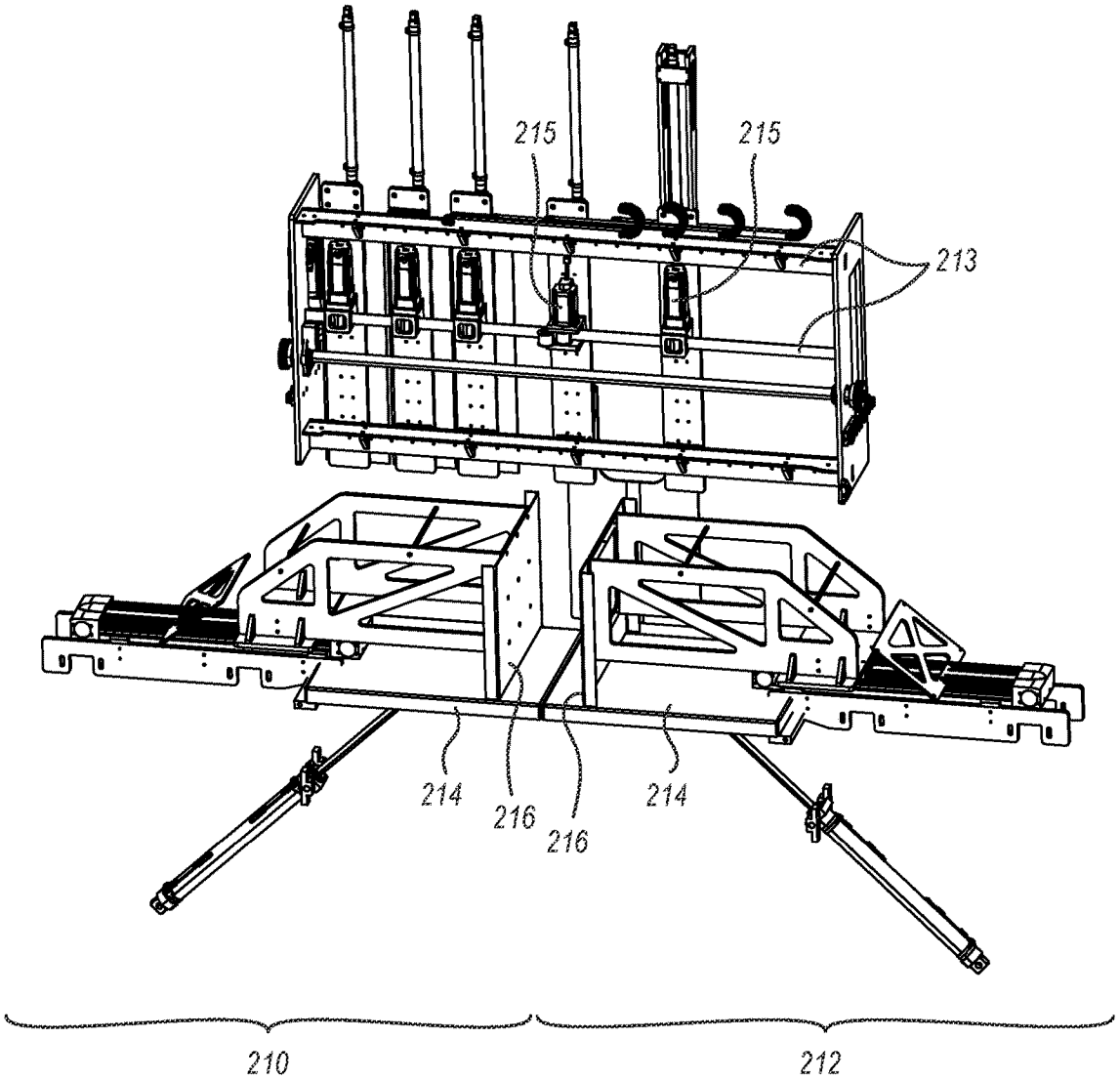
FIG. 26 illustrates a rear view of a pre-crowder and front wall assembly of the crowder assembly of FIG. 25.
Figure 27:
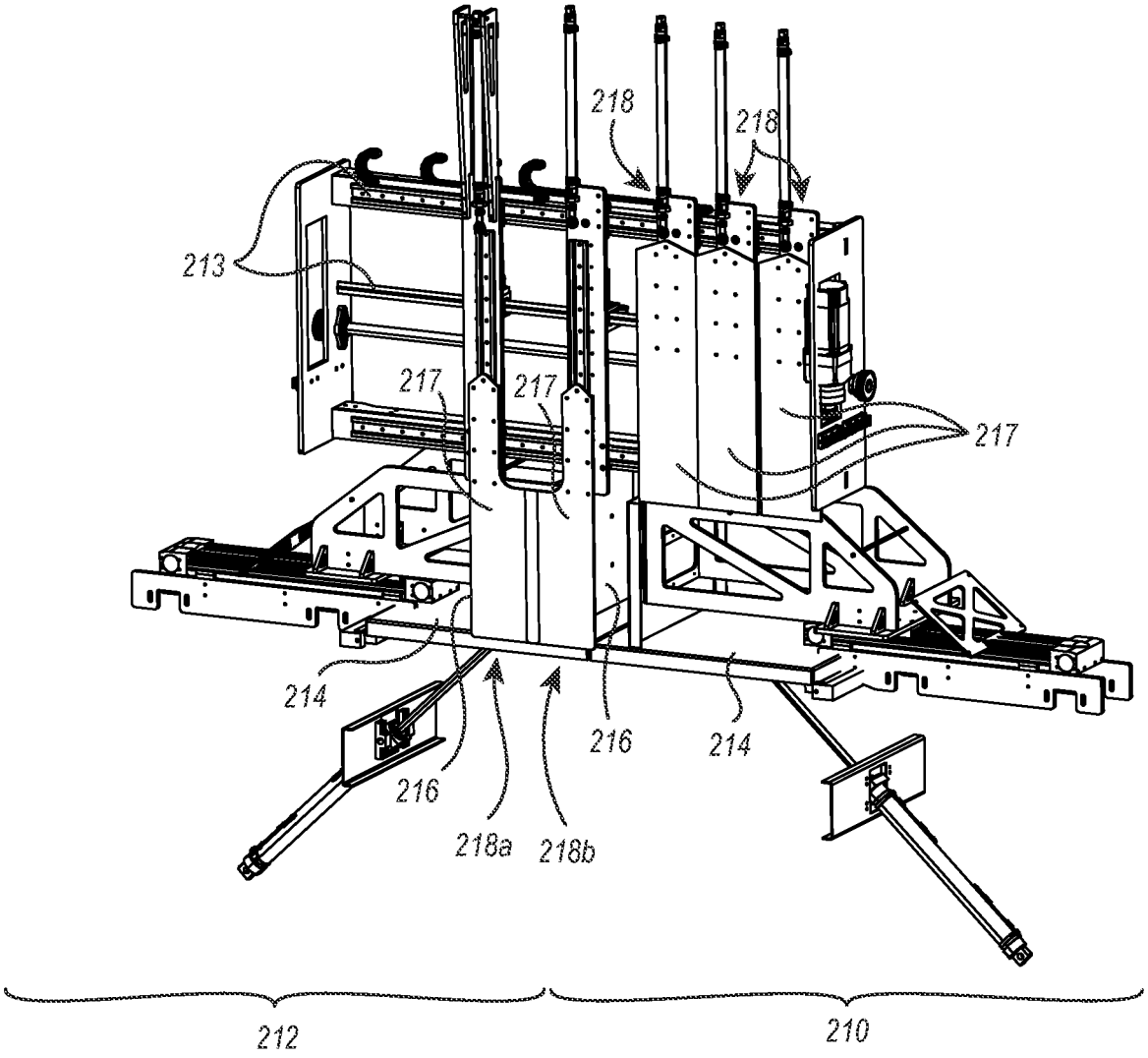
FIG. 27 illustrates a front view of the pre-crowder and front wall assembly of FIG. 26.

FIGS. 26 and 27 illustrate rear and front perspective views of the pre-crowder 202 and the front wall assembly 206. As best seen in FIG. 26, the pre-crowder 202 includes a first half 210 and a second half 212. Each of the first half 210 and the second half 212 includes a floor 214 and a sidewall 216. The floors 214 can provide a surface on which a stack of to-be-packaged items can be placed. In some embodiments, the floors 214 can be movable (e.g., hinged) to allow for the floors 214 to be moved to provide access deeper into the crowder assembly 200 for maintenance, etc.

Similar to sidewalls 144, sidewalls 216 may move relative to one another and relative to the floors 214 of the corresponding half. The sidewalls 216 may be spaced apart so that a stack of items may be delivered into the pre-crowder 202 between the sidewalls 216. Once the stack of items is position within the pre-crowder 202 (e.g., on floors 214 and between sidewalls 216), the sidewalls 216 may be moved towards one another (and relative to the floors 214) and towards the stack disposed therebetween until the sidewalls 216 are positioned against or adjacent to the stack of items.

Once the sidewalls 216 are positioned against or adjacent to the stack of items, the front wall assembly 206 may be activated to form a front wall adjacent or against the stack of items and between the side walls 216. For instance, as best seen in FIG. 27, portions of the front wall assembly 206 may be moved to form the front wall.

In the illustrated embodiment, the front wall assembly 206 includes a plurality of front wall sections 218 that may be moved horizontally and/or vertically (individually or in various combinations) to create a front wall. The front wall sections 218 may be mounted on one or more tracks 213 that enable the front wall sections 218 to move horizontally. Likewise, the front wall sections 218 may include one or more actuators 215 to facilitate movement (e.g., vertical movement) of one or more plate 217 thereof.

The number of front wall sections 218 that are moved into a wall position may be determined by the distance between the sidewalls 216 (which is determined by the width of the stack of items within the pre-crowder 202). In some embodiments, some of the front wall sections 218 have similar widths while others of the front wall sections 218 may have a width that is different than other front wall sections 218.

In the illustrated embodiment, as best seen in FIG. 27, the front wall assembly 206 may include front wall sections 218*a* and 218*b* that can at least partially overlap one another to provide greater variability in the width of the front wall formed with the front wall assembly 206. More specifically, front wall sections 218*a* and 218*b* may include plates 217 having a predetermined width and which can at least partially overlap one another. For instance, in some embodiments, the plates 217 of front wall sections 218*a* and 218*b* can each be about 8 inches wide. The plates 217 can at least partially overlap one another such that the plates 217 of front wall sections 218*a* and 218*b* can form a front wall having a width anywhere from about 8 inches wide to about 15 inches wide (with a 1 inch overlap). In some embodiments, the plates 217 of front wall sections 218*a* and 218*b* can always remain at least partially overlapped with one another such that the plates 217 of front wall sections 218*a* and 218*b* can form a front wall having a width anywhere from about 8 inches wide to about 15 inches wide (with a 1 inch overlap of the plates 217). In other embodiments, the plates 217 of front wall sections 218*a* and 218*b* may not always overlap one another. In such embodiments, the plates 217 thereof may form a front wall having a width anywhere from about 8 inches to about 16 inches.

If a front wall needs to be formed that is wider that that provided by front wall sections 218*a* and 208*b*, additional front wall sections 218 can be moved into position adjacent front wall sections 218*a* and 218*b*. For instance, if a front wall of about 20 inches needs to be formed, front wall sections 218*a* and 218*b* can be moved into place to form about 13 inches of the front wall (by partially overlapping the plates 217 thereof). Additionally, another front wall section 218 (with plate 217 having a width of about 7 inches) can be moved into place adjacent the front wall sections 218*a* and 218*b* to form the remainder of the 20 inch wide front wall. Likewise, the plates 217 of the front wall sections 218*a* and 218*b* can be moved to overlap more or less and additional front wall sections 218 can be moved into place to form a front wall having substantially any desired width.

While the plates 217 have been described as having specific widths (e.g., 8 inches or 7 inches), it will be appreciated that those dimensions are merely exemplary. In other embodiments, the plates 217 may have widths smaller than 7 inches, between 7 and 8 inches, or larger than 8 inches. Similarly, some of the plates 217 may have different sizes from one another. Furthermore, the amount of overlap between adjacent plates may vary from one embodiment to another. Furthermore, while the illustrated embodiment only shows two plates that overlap one another, it will be appreciated that additional front wall sections 218 may have plates that overlap one another.

Once the front wall is arranged between the side walls 216, the front wall assembly 206 can be moved towards the stack of items positioned within the pre-crowder 202. The front wall can further stabilize the stack of items so the stack of items does not fall over or become disorganized. Additionally, the front wall can move the stack of items from the pre-crowder 202 into the crowder 204. More specifically, the front wall assembly 206 can move (horizontally) towards the crowder 204. Such movement of the front wall assembly 206 can cause the front wall (formed with the front wall sections 218) to push the stack of items from the pre-crowder 202 into the crowder 204.

Figure 28:
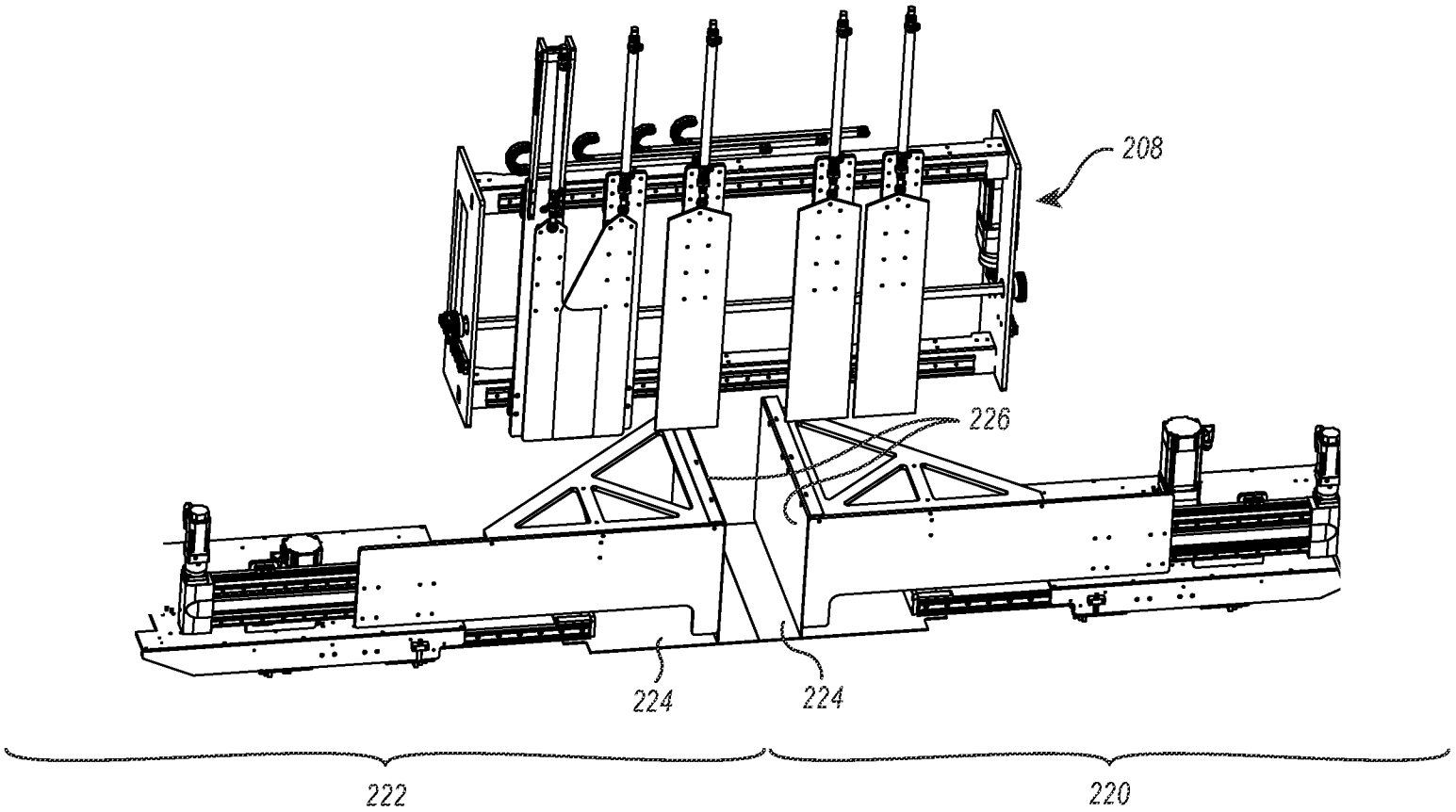
FIG. 28 illustrates a front view of a crowder and back wall assembly of the crowder assembly of FIG. 25.

As can be seen in FIG. 28, the crowder 204 includes a first half 220 and a second half 222. Each of the first half 220 and the second half 222 includes a floor 224 and a sidewall 226. The floors 224 can provide a surface on which the stack of to-be-packaged items can be placed. Similar to sidewalls 216, sidewalls 226 may move relative to one another and relative to the floors 224 of the corresponding half. The sidewalls 226 may be spaced apart so that the stack of items may be delivered into the crowder 204 between the sidewalls 226.

In some embodiments, the sidewalls 226 are moved towards one another prior to the stack of items being moved into the crowder 204. For instance, the sidewalls 226 may move towards one another at about the same time the sidewalls 216 of the pre-crowder 202 are moved towards one another. In other embodiments, the sidewalls 226 are moved towards one another after the stack of items has been moved into the crowder 204.

Additionally, the back wall assembly 208 may form a back wall of the crowder 204. The back wall assembly 208 may be substantially similar to the front wall assembly 206 (e.g., movable back wall sections with plates that form a back wall). The back wall assembly 208 may form a back wall at about the same time that the front wall assembly 206 forms the front wall as described above. Alternatively, the back wall assembly 208 may form the back wall while or after the stack of items is moved into the crowder 204.

In any event, once the stack of items is positioned in the crowder 204 with sidewalls 226 and the front and back walls positioned adjacent to or against the stack of items, the stack of items is securely held in the desired arrangement. Thereafter, the crowder 204 and the front and back wall assemblies 206, 208 can move towards a packaging station where the stack of items are packaged within a box. The movement of the crowder 204 and packaging of the stack of items can be similar to that described above in connection with crowder assembly 130 and FIGS. 8-24.

Generally, for instance, the crowder 204 (with the front and back walls) can move the stack of items over the top of a box template. The box template can then be folded around the stack of items to package the items in the box formed with the box template. As the box template is folded around the stack of items, the crowder 204 and the front and back walls can be withdrawn or retracted. By way of example, after the box template is folded as shown in FIG. 9, the back wall (formed by back wall assembly 208) and the floors 224 can be retracted or withdrawn (which will deposit the stack of items on the box template). Thereafter, the sidewalls 226 can be withdrawn or retracted to allow for the box template to be folded to form sidewalls of a box. Similarly, the front wall (formed by front wall assembly 206) can be retracted or withdrawn prior to or after the box template is folded to form a front wall of the box (similar to that shown in FIGS. 14-15). The remainder of the box template can be folded and secured closed as described above.

The above described system 120 and method 100 may include or use box templates having particular configurations. Box template 148 referenced herein is one example box template that may be used with system 120 and method 100. U.S. application Ser. No. 16/435,252, filed Jun. 7, 2019, and entitled BOX TEMPLATE (the "'252 Application"), which is incorporated herein by reference in its entirety, relates to one example box template that may be used with the systems and methods described herein. The '252 Application describes and illustrates various features of an example box template, as well as an exemplary process for folding and securing the box template in the form of a box with a stack of items therein. The packaging machine 124 described herein can perform the folding and securing steps described in the '252 Application to form a completed box. For instance, the folding and securing steps illustrated in FIGS. 9-25 hereof and performed by the packaging machine 124 may be similar or identical to the folding and securing steps described and illustrated in the '252 Application.

In light of the above, one embodiment includes a packaging machine comprising a frame structure and a crowder assembly movably mounted on the frame structure and configured to receive and maintain an arrangement of a stack of one or more items during a packaging process. The crowder assembly includes a first half, a second half, a back, a floor, and a front wall assembly. The first half includes a back wall, a floor, and a sidewall. The second half includes a sidewall positioned opposite the sidewall of the first half. The sidewall of the second half is selectively movable towards and away from the sidewall of the first half. The back is associated with at least one of the first half and the second half. The floor is associated with at least one of the first half and the second half. The front wall assembly has a variable width to enable the front wall to be positioned between the sidewalls of the first and second halves. The front wall assembly is selectively movable towards the back wall.

In some embodiments, the front wall assembly is movable along the frame structure independent of the first and second halves. In some embodiments, each of the first half and the second half comprises a back wall and a floor. In some embodiments, the sidewall of the first half is selectively movable towards and away from the sidewall of the second half.

In some embodiments, the crowder assembly is configured to have a stack of one or more items disposed on the floor and between the sidewalls of the first and second halves. In some embodiments, the sidewall of the second half is configured to move towards the sidewall of the first half with the stack of one or more items therebetween until the distance between the sidewalls of the first and second halves is generally equal to a dimension of the stack of one or more items.

In some embodiments, the front wall assembly is configured to move towards the back wall with a stack of one or more items therebetween until the distance between the front wall assembly is generally equal to a dimension of the stack of one or more items. In some embodiments, the front wall assembly comprises a plurality of front wall sections. In some embodiments, each of the plurality of front wall sections can be selectively raised and lowered between the sidewalls of the first and second halves. In some embodiments, the crowder assembly is configured to move along the frame structure to position the stack of one or more items over a panel of a box template.

In some embodiments, the packaging machine also includes one or more folding mechanism configured to fold the box template around the stack of one or more items. In some embodiments, components of the crowder assembly are configured to be sequentially withdrawn or retracted away from the stack of one or more items as the folding mechanisms fold the box template around the stack of one or more items. In some embodiments, the folding mechanisms is configured to fold a portion of the box template against the back wall on a side of the back wall opposite to the stack of one or more items. In some embodiments, the floor and back wall are configured to be withdrawn or retracted away from the stack of one or more items, thereby depositing the stack of one or more items on the panel of the box template. In some embodiments, the sidewalls of the first and second halves are configured to be withdrawn or retracted away from the stack of one or more items after the floor and back are withdrawn or retracted. In some embodiments, the front wall assembly is configured to be withdrawn or retracted away from the stack of one or more items after the sidewalls of the first and second halves. In some embodiments, the first and second halves are configured to move along the frame structure away from the stack of one or more items before the front wall assembly is withdrawn or retracted. In some embodiments, the front wall assembly is configured to move along the frame structure away from the stack of one or more items after the first and second halves move along the frame structure away from the stack of one or more items. In some embodiments, the packaging machine further comprises one or more fastening apparatuses that are configured to apply one or more fasteners to the box template to secure various flaps of the box template together around the stack of one or more items. In some embodiments, the packaging machine further comprises a converting assembly that is configured to form box templates.

In another embodiment, a system for packaging one or more items includes an order arrangement station where the one or more items can be arranged into a stack. The system can also include one or more dimensioning mechanisms configured to determine outer dimensions of the stack. The system can also include a converting assembly configured to create a box template that when erected forms a box that is custom sized to the dimensions of the stack. The system can also include a crowder assembly that is configured to hold and maintain the stack in a desired configuration while the box template is at least partially folded around the stack. The system can also include one or more folding mechanisms configured to fold the box template around the stack. The system can also include one or more fastening apparatuses that are configured to apply one or more fasteners to the box template to secure the box template around the stack in the form of a box.

In some embodiments, the crowder assembly comprises a first half, a second half, and a front wall assembly. In some embodiments, each of the first half and the second half comprises a back wall, a floor, and a sidewall. In some embodiments, the sidewall of the first half is configured to move relative to the back wall and floor of the first half and towards and away from the sidewall of the second half. In some embodiments, the sidewall of the second half is configured to move relative to the back wall and floor of the second half and towards and away from the sidewall of the first half. In some embodiments, the front wall assembly comprises a plurality of front wall sections that are configured to be selectively raised and lowered between the sidewalls of the first and second halves. In some embodiments, the front wall sections are configured to be selectively movable towards the back walls of the first and second halves. In some embodiments, the crowder assembly comprises a pre-crowder, a crowder, a front wall assembly, and a back wall assembly. In some embodiments, the pre-crowder comprises opposing sidewalls and a floor, the opposing sidewalls being moveable relative to one another and the floor. In some embodiments, the front wall assembly comprises a plurality of front wall sections configured to move into position adjacent to the one or more items to form a front wall. In some embodiments, the plurality of front wall sections comprises a first front wall section and a second front wall section, the first and second front wall sections comprise at least partially overlapping plates. In some embodiments, the first and second front wall sections are movable relative to one another to vary the amount of overlap of the plates. In some embodiments, the crowder comprises a first half and a second half, each of the first and second halves comprising a sidewall and a floor, the sidewalls being moveable relative to one another and the floors. In some embodiments, the back wall assembly comprises a plurality of back wall sections configured to move into position adjacent to the one or more items to form a back wall. In some embodiments, the plurality of back wall sections comprises a first back wall section and a second back wall section, the first and second back wall sections comprise at least partially overlapping plates . In some embodiments, the first and second back wall sections are movable relative to one another to vary the amount of overlap of the plates. In some embodiments, the crowder is configured to move away from and towards the pre-crowder. In some embodiments, the front wall assembly and the back wall assembly are configured to move with the crowder away from and towards the pre-crowder.

In still another embodiment, a method for packaging one or more items includes arranging the one or more items into a stack with a desired configuration. The method also includes determining the outer dimensions of the stack and creating a box template that when erected forms a box that is custom sized to the dimensions of the stack. The method also includes depositing the stack in a crowder assembly configured to hold and maintain the stack in the desired configuration while the box template is at least partially folded around the stack. The method also includes folding the box template around the stack and securing the box template around the stack in the form of a box.

In some embodiments, the method further includes adjusting one or more components of the crowder assembly such that the components of the crowder assembly are positioned around the stack and have dimensions similar to those of the stack. In some embodiments, the method further comprises sequentially withdrawing or retracting components of the crowder assembly away from the stack as the box template is folded around the stack.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A packaging machine comprising:

a crowder assembly configured to receive and maintain an arrangement of a stack of one or more items during a packaging process, the crowder assembly comprising:

a floor configured to have the stack of one or more items positioned thereon;

first and second opposing sidewalls, at least one of the first and second sidewalls being configured to selectively move closer to and further from the other sidewall, the first and second opposing sidewalls being configured to be positioned on opposing sides of the stack of one or more items;

a back wall or back wall assembly configured to have the stack of one or more items positioned thereagainst; and a front wall assembly positioned opposite to the back wall or back wall assembly such that the front wall assembly and the back wall or back wall assembly are positioned on opposing sides of the stack of one or more items, the front wall assembly being configured to be positioned between the first and second opposing sidewalls and configured to selectively move towards the back wall or back wall assembly.

2. The packaging machine of claim 1, wherein the crowder assembly is configured to have a box template is wrapped partially therearound.

3. The packaging machine of claim 2, wherein the back wall or back wall assembly is selectively retractable away from the stack of one or more items as the box template it wrapped therearound.

4. The packaging machine of claim 3, wherein the back wall or back wall assembly is selectively retractable by raising the back wall or back wall assembly upward away from the floor.

5. The packaging machine of claim 2, wherein the front wall is selectively retractable away from the stack of one or more items as the box template it wrapped therearound.

6. The packaging machine of claim 5, wherein the front wall is selectively retractable by raising the front wall upward away from the floor.

7. The packaging machine of claim 2, wherein the first and second opposing sidewalls are selectively retractable away from the stack of one or more items as the box template it wrapped therearound.

8. The packaging machine of claim 7, wherein the first and second opposing sidewalls are selectively retractable by moving one or both of the first and second opposing sidewalls away from the other sidewall.

9. The packaging machine of claim 2, wherein the floor is selectively retractable from under the stack of one or more items as the box template it wrapped therearound.

10. The packaging machine of claim 9, wherein the floor comprises a first half and a second half, the first and second halves being selectively movable away from one another to selectively retract the floor from under the stack of one or more items.

11. A packaging machine comprising:

a crowder assembly configured to receive and maintain an arrangement of a stack of one or more items during a packaging process, the crowder assembly comprising:

a first half comprising a back wall portion, a floor portion, and a sidewall portion;

a second half comprising a back wall portion, a floor portion, and a sidewall portion, the sidewall portion of the second half being positioned opposite the sidewall portion of the first half, the sidewall portion of the second half being selectively movable towards and away from the sidewall portion of the first half;

a front wall assembly configured to be positioned between the sidewall portions of the first and second halves, the front wall assembly being selectively movable towards the back wall.

12. The packaging machine of claim 11, further comprising a frame structure upon which the crowder assembly is movably mounted.

13. The packaging machine of claim 12, wherein the front wall assembly is movable along the frame structure independent of the first and second halves.

14. The packaging machine of any of claim 11, wherein the sidewall portion of the first half is selectively movable towards and away from the sidewall portion of the second half.

15. The packaging machine of any of claims 11, wherein the crowder assembly is configured to have a stack of one or more items disposed on the floor portions and between the sidewall portions of the first and second halves and between the front wall and the back wall portions.

16. The packaging machine of claim 11, wherein components of the crowder assembly are configured to be sequentially withdrawn or retracted away from the stack of one or more items as the folding mechanisms fold the box template around the stack of one or more items.

17. A packaging machine, comprising:

a converting assembly configured to create a box template that when erected forms a box that is custom sized to dimensions of a stack of one or more items;

a crowder assembly that is configured to hold and maintain the stack in a desired configuration while the box template is at least partially folded around the stack; and one or more folding mechanisms configured to fold the box template around the stack.

18. The system of claim 17, wherein the crowder assembly comprises a first half, a second half, and a front wall assembly.

19. The system of claim 17, wherein each of the first half and the second half comprises a back wall portion, a floor portion, and a sidewall portion.

20. The system of claim 19, wherein the sidewall portion of the first half is configured to move relative to the back wall portion and the floor portion of the first half and towards and away from the sidewall portion of the second half.

* * * * *